US010761449B1

(12) United States Patent
Narita et al.

(10) Patent No.: US 10,761,449 B1
(45) Date of Patent: Sep. 1, 2020

(54) CHARGING DEVICE, PROCESS CARTRIDGE, AND IMAGE FORMING APPARATUS

(71) Applicant: FUJI XEROX CO., LTD., Tokyo (JP)

(72) Inventors: Kosuke Narita, Kanagawa (JP); Akihiro Nonaka, Kanagawa (JP); Hiroko Kobayashi, Kanagawa (JP); Yasuhiko Kinuta, Kanagawa (JP); Fuyuki Kano, Kanagawa (JP); Yuki Tagawa, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/522,792

(22) Filed: Jul. 26, 2019

(30) Foreign Application Priority Data

Mar. 20, 2019 (JP) ..... 2019-052983

(51) Int. Cl.
*G03G 15/02* (2006.01)

(52) U.S. Cl.
CPC ..... *G03G 15/0258* (2013.01); *G03G 15/0225* (2013.01); *G03G 15/0233* (2013.01)

(58) Field of Classification Search
CPC ..... G03G 15/0258; G03G 15/0225; G03G 15/0233
See application file for complete search history.

(56) References Cited

U.S. PATENT DOCUMENTS

| | | | | |
|---|---|---|---|---|
| 7,706,713 | B2 | 4/2010 | Terai et al. | |
| 9,639,020 | B1 * | 5/2017 | Kano | G03G 15/0225 |
| 9,746,792 | B1 * | 8/2017 | Hayashi | G03G 15/0233 |
| 10,423,118 | B1 * | 9/2019 | Mizoguchi | G03G 15/0225 |
| 2012/0082475 | A1 * | 4/2012 | Kawai | G03G 15/0225 399/100 |
| 2018/0364605 | A1 * | 12/2018 | Yoshida | G03G 15/0258 |

FOREIGN PATENT DOCUMENTS

| | | |
|---|---|---|
| JP | 2007-127849 A | 5/2007 |
| JP | 2008-015323 A | 1/2008 |
| JP | 2015-152829 A | 8/2015 |

* cited by examiner

*Primary Examiner* — Sophia S Chen
(74) *Attorney, Agent, or Firm* — Sughrue Mion, PLLC

(57) ABSTRACT

A charging device includes: a charging member that charges an image holding member according to a contact charging method, and includes a conductive substrate and a surface layer provided on the conductive substrate; and a clean member that cleans the charging member while contacting the charging member, and includes a shaft and a foamed elastic layer provided on the shaft, wherein a ratio of a distance between irregularities in an axial direction of the surface layer in the charging member (Sm) to a width of a nodal section of a foam cell wall surface protruding from a surface of the foamed elastic layer in the clean member (W) satisfies $2.4 \leq Sm/W \leq 5.9$.

11 Claims, 13 Drawing Sheets

CHARGING DEVICE, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2019-052983 filed on Mar. 20, 2019.

BACKGROUND

(i) Technical Field

The present invention relates to a charging device, a process cartridge, and an image forming apparatus.

(ii) Related Art

In an image forming apparatus using an electrophotographic system, first, electric charge is formed on a surface of an image holding member made of a photoconductive photoreceptor containing an inorganic or organic material using a charging device, an electrostatic latent image is formed by a laser beam or the like which modulates an image signal, and then the electrostatic latent image is developed with charged toner so as to form a visualized toner image. Then, the toner image is electrostatically transferred to a transfer material such as a recording sheet directly or via an intermediate transfer body, and fixed on the recording material to obtain a reproduced image.

JP-A-2015-152829 discloses a charging device includes a roll-shaped charging member that includes a conductive support, a conductive elastic layer provided on an outer circumferential surface of the conductive support and a conductive surface layer provided on an outer circumferential surface of the conductive elastic layer, and has surface free energy of 50 mN/m to 90 mN/m; and a roll-shaped clean member that includes a support and a foamed elastic layer which is provided on an outer circumferential surface of the support and has the number of the foaming cells of 40 to 75 per 25 mm, and rotates being in contact with the conductive surface layer of the charging member.

JP-A-2008-015323 discloses a charging device including a charging member which is brought into contact with a body to be charged and charges the body to be charged by applying a voltage between the charging member and the body to be charged, in which the charging member is in a roll shape and includes a semiconductive layer on a metallic core and at least one or more upper layers on the semiconductive layer, and when a distance between irregularities on a surface of the charging member is set as RSm, 30 μm≤RSm≤320 μm is satisfied, and when ten-point average surface roughness of the surface of the charging member is set as Rz, 1.1 μm≤Rz≤5 μm is satisfied.

JP-A-2007-127849 discloses an image forming apparatus including an image holding member, a charging roll that rotates while being in contact with the image holding member to charge the image holding member, and a clean member that is in contact with the surface of the charging roll to remove deposits on the surface of the charging roll, in which the clean member is a foamed body having an average cell diameter of 0.18 mm to 1.0 mm and a ten-point surface roughness (Rz) of the charging roll of 1 μm to 17 μm.

When contaminants on the image holding member (for example, an electrophotographic photoreceptor) is transferred to the charging member, the charging ability of the charging member may be reduced, and when the charging ability is lowered, for example, there may be a case where an image defect of an image streak failure (a streak image defect) occurs.

SUMMARY

Aspects of non-limiting exemplary embodiments of the present disclosure relate to a charging device which prevents occurrence of an image streak failure, as compared with a charging device including a charging member that charges an image holding member according to a contact charging method, and includes a surface layer, and a clean member that cleans the charging member while contacting the charging member, and has a foamed elastic, in which a ratio (Sm/W) of a distance between irregularities of the surface layer in the charging member (Sm) to a width of a nodal section of a foam cell wall surface protruding from the surface of the foamed elastic layer in the clean member (W) is less than 2.4 or larger than 5.9.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a charging device including:

a charging member that charges an image holding member according to a contact charging method, and includes a conductive substrate and a surface layer provided on the conductive substrate; and a clean member that cleans the charging member while contacting the charging member, and includes a shaft and a foamed elastic layer provided on the shaft, wherein a ratio of a distance between irregularities in an axial direction of the surface layer in the charging member (Sm) to a width of a nodal section of a foam cell wall surface protruding from a surface of the foamed elastic layer in the clean member (W) satisfies 2.4≤Sm/W≤5.9.

BRIEF DESCRIPTION OF THE DRAWINGS

Exemplary embodiments of the present invention will be described in detail based on the following figures, wherein.

DETAILED DESCRIPTION

Figure 1:
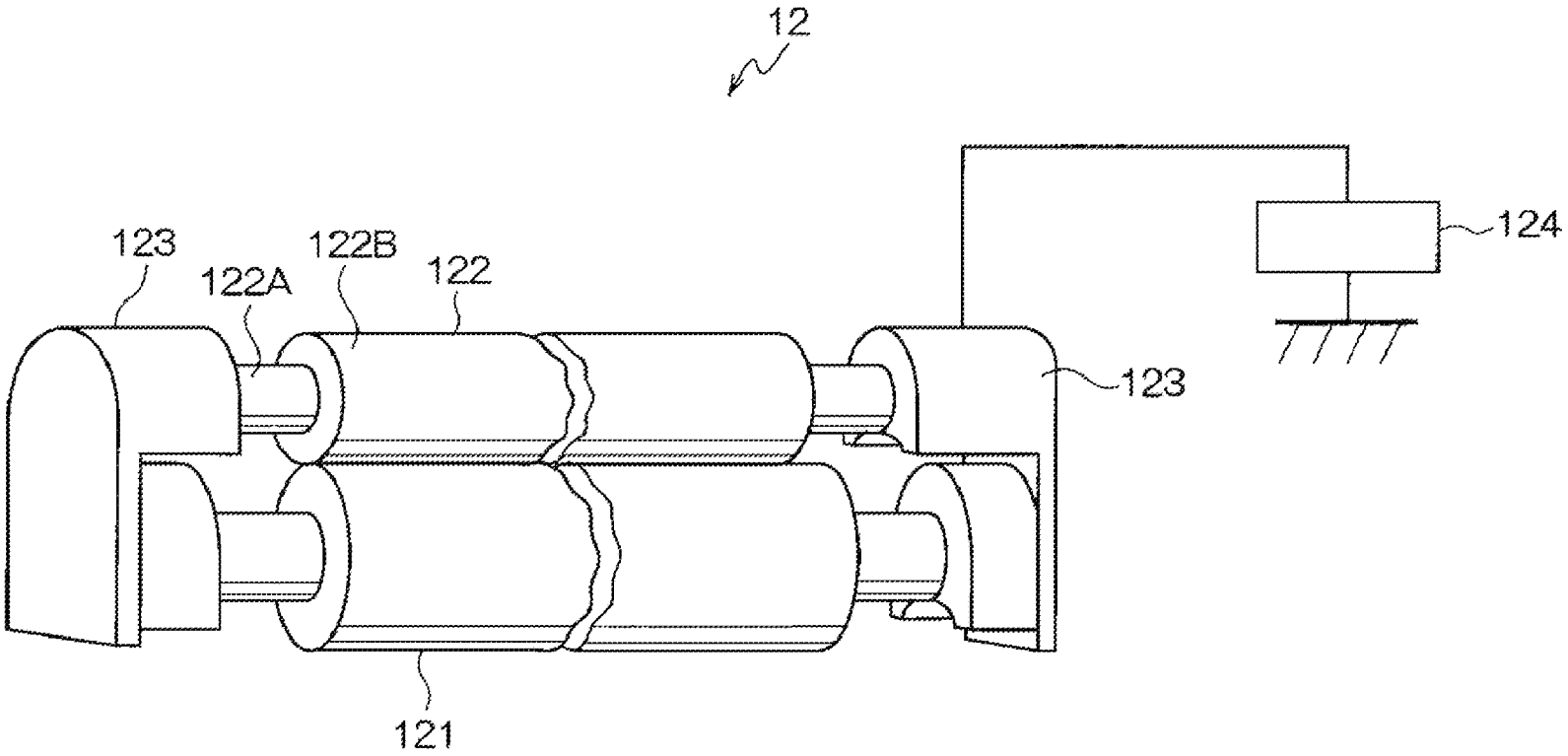
FIG. 1 is a schematic perspective view illustrating an example of a charging device according to an exemplary embodiment.

Hereinafter, exemplary embodiments of the invention will be described. These descriptions and examples illustrate the exemplary embodiments and do not limit the scope of the invention.

In a case where the amount of each component in the composition is referred to in the present specification, when there are plural substances corresponding to each component in the composition, unless otherwise specified, it means the total amount of the plural substances present in the composition. In the present specification, "electrophotographic photoreceptor" is also simply referred to as "photoreceptor". In the present specification, "axial direction" of the charging member means a direction in which the rotation shaft of the charging member extends. Further, in the present specification, "conductive" means that the volume resistivity at 20° C. is $1\times10^{14}$ Ωcm or less.

<Charging Device>

The charging device according to the exemplary embodiment includes a charging member that charges an image holding member according to a contact charging method, and includes a conductive substrate and a surface layer provided on the conductive substrate, and a clean member that cleans the charging member while contacting the charging member, and includes a shaft and a foamed elastic layer provided on the shaft. In addition, a ratio of a distance between irregularities in an axial direction of the surface layer in the charging member (Sm) to a width of the nodal section of the foam cell wall surface protruding from a surface of a foamed elastic layer in the clean member (W) satisfies $2.4 \leq Sm/W \leq 5.9$.

In a region of current electrophotographic technology, construction of a small-sized and low-cost electrophotographic apparatus is required, and a contact charging method is often adopted for charging. Furthermore, in recent days, in order to achieve more reliability, the ability of the charging member to charge the photoreceptor (an example of the image holding member) is required to be maintained over a long period of time; however, on the surface of the charging member, maintenance of the target charging ability may not be secured due to electrical deterioration caused by contamination by toner particles and external additives which are components of toner. When the charging ability is deteriorated, it appears as an image quality defect such as an image streak failure. In other words, there is a need to improve the contamination characteristics of the charging member surface.

Contamination by the toner particles and the external additives when using a charging member for contact charging method is caused by toners and external additives so-called "pass through", which is not completely cleaned by the photoreceptor-cleaning portion, present at a contact portion between the photoreceptor and the charging member. For the removal of the contaminants on the charging member, a method of performing cleaning by a clean member for the charging member is known, but the contaminants originally present on the photoreceptor transfers to the charging member at the contact portion between the photoreceptor and the charging member.

When the contaminant transferred to the charging member from the photoreceptor (an example of the image holding member) is cleaned by the clean member, the cleaning is performed by the nodal section of the foam cell wall surface protruding from the surface of the foamed elastic layer. In particular, when removing the contaminant attached to a recessed portion in a uneven shape on the surface of the charging member, if the distance Sm between irregularities of the surface layer in the charging member is small, the nodal section of the foam cell wall surface protruding from the surface of the foamed elastic layer is hard to enter and thus it is not easy to remove the contaminants. On the other hand, when the width of the nodal section of the foam cell wall surface protruding from the surface of the foamed elastic layer is large, the nodal section is hard to enter and it is not easy to remove the contaminants.

On the other hand, with the charging member according to the exemplary embodiment having the above-described configuration, an image exhibiting less image streak failure may be obtained (that is, the occurrence of the image streak failure is prevented). Though the reason is not clear, it is assumed as follows.

By using the charging member having a a large distance Sm between irregularities of the surface layer in combination with the clean member having a small width of the nodal section of the foam cell wall surface protruding from the surface of the foamed elastic layer serving as a contaminant removal function point, it becomes easy to remove the contaminants attached to the charging member. That is, when the ratio (Sm/W) of the distance between irregularities of the surface layer in the charging member (Sm) to the width of the nodal section of the foam cell wall surface protruding from the surface of the foamed elastic layer in the clean member (W) is within the above range, it is considered that it becomes easy to remove the contaminant attached to the charging member, and thus the occurrence of the image streak failure is prevented.

Hereinafter, details of the charging device according to the exemplary embodiment will be described with reference to FIG. 1. FIG. 1 is a schematic perspective view illustrating an example of the charging device according to an exemplary embodiment.

As illustrated in FIG. 1, in a charging device 12 according to the exemplary embodiment, a charging member 121 and a clean member 122 are disposed in contact with each other with a specific biting amount. In addition, both axial end portions of a conductive substrate (30 in FIG. 2) of the charging member 121 and a shaft 122A of the clean member 122 are held by a conductive bearing 123 (for example, conductive bearing) such that each member is freely rotatable. One side of the conductive bearing 123 is connected to a power supply 124. The charging member 121 is, for example, a roll member including a conductive substrate (30 in FIG. 2) and a surface layer (32 in FIG. 2) provided on the conductive substrate (30 in FIG. 2). The clean member 122 is, for example, a roll member including a shaft 122A and a foamed elastic layer 122B provided on the outer circumferential surface of the shaft 122A. As described above, the charging device according to the exemplary embodiment is described with reference to FIG. 1, but the exemplary embodiment is not limited thereto.

In the charging device according to the exemplary embodiment, any of a method of applying only a DC voltage to the charging member, a method of applying only an AC voltage to the charging member, and a method of applying a voltage in which the AC voltage is superimposed on the DC voltage to the charging member may be adopted.

Figure 15:
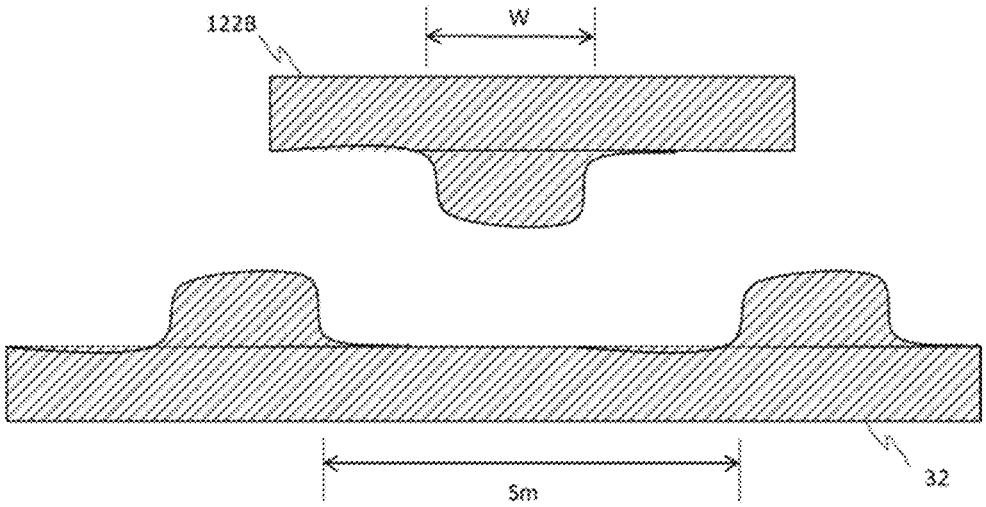
FIG. 15 is a diagram illustrating the width W of a nodal section of a foam cell wall surface 122B of a foamed elastic layer in the clean member and the distance between irregularities of the surface layer 32 in the charging member (Sm) having protruding peak heights (Spk), according to an exemplary embodiment.

In the charging device according to the exemplary embodiment, a ratio of a distance Sm between irregularities in an axial direction of the surface layer in the charging member 32 to a width W of the nodal section of the foam cell wall surface 122B protruding from a surface of a foamed elastic layer in the clean member satisfies $2.4 \leq Sm/W \leq 5.9$. See FIG. 15. From the viewpoint of preventing the occurrence of image streak failure, the ratio of Sm/W preferably satisfies $2.6 \leq Sm/W \leq 5.0$, and more preferably satisfies $3.0 \leq Sm/W \leq 4.6$.

In the charging device in the exemplary embodiment, it is more preferable that the ratio (Sm/Rz) of the distance Sm between irregularities of the surface layer in the axial direction to the ten-point average roughness Rz of the surface layer in the charging member in the axial direction satisfies $15 \leq Sm/Rz \leq 35$, and the width W of the nodal section of the foam cell wall surface is 30 μm to 50 μm from the viewpoint of preventing the occurrence of image streak failure. It is more preferable that the ratio Sm/Rz satisfies $20 \leq Sm/Rz \leq 30$, and the width W of the nodal section of the foam cell wall surface is 35 μm to 45 μm.

When the ratio of Sm/Rz in the charging member is 35 or less, and the width W of the nodal section of the foam cell wall surface in the clean member is 30 or more, the contact between the photoreceptor and the irregularities on the surface of the charging roll is easily prevented, and the contact point is reduced. As a result, the amount of contaminant transferred from the photoreceptor as the member to be charged to the charging member is easily prevented. In addition, when the ratio Sm/Rz in the charging member is 15 or less, and the width W of the nodal section of the foam cell wall surface in the clean member is 50 m or less, the contact points of the charging member surface and the clean member are increased (that is, the nodal section of the elastic layer in the clean member enters even in a gap formed in the uneven shape on the charging member surface), and more contaminants are removed, and thus deterioration of the charging ability of the charging member is prevented and in the obtained image, the occurrence of streaks in the obtained image is easily prevented.

A method of measuring the distance Sm between irregularities in the axial direction of the surface layer in the charging member, and a method of measuring width W of the nodal section of the foam cell wall surface protruding from the surface of the foamed elastic layer in the clean member will be described later.

Next, each portion constituting the charging device according to the exemplary embodiment will be described.

(Charging Member)

The charging member in the exemplary embodiment will be described. The charging member in the exemplary embodiment is a charging member that charges the image holding member according to a contact charging method. The charging member includes, for example, a conductive substrate, an elastic layer provided on the conductive substrate, and a surface layer provided on the elastic layer.

The shape of the charging member according to the exemplary embodiment is not particularly limited, and may be a roll shape, a brush shape, a belt (tube) shape, a blade shape or the like. Among these, a roll-shaped charging member as illustrated in FIG. 2, that is, a so-called charging roll is preferable.

Figure 2:
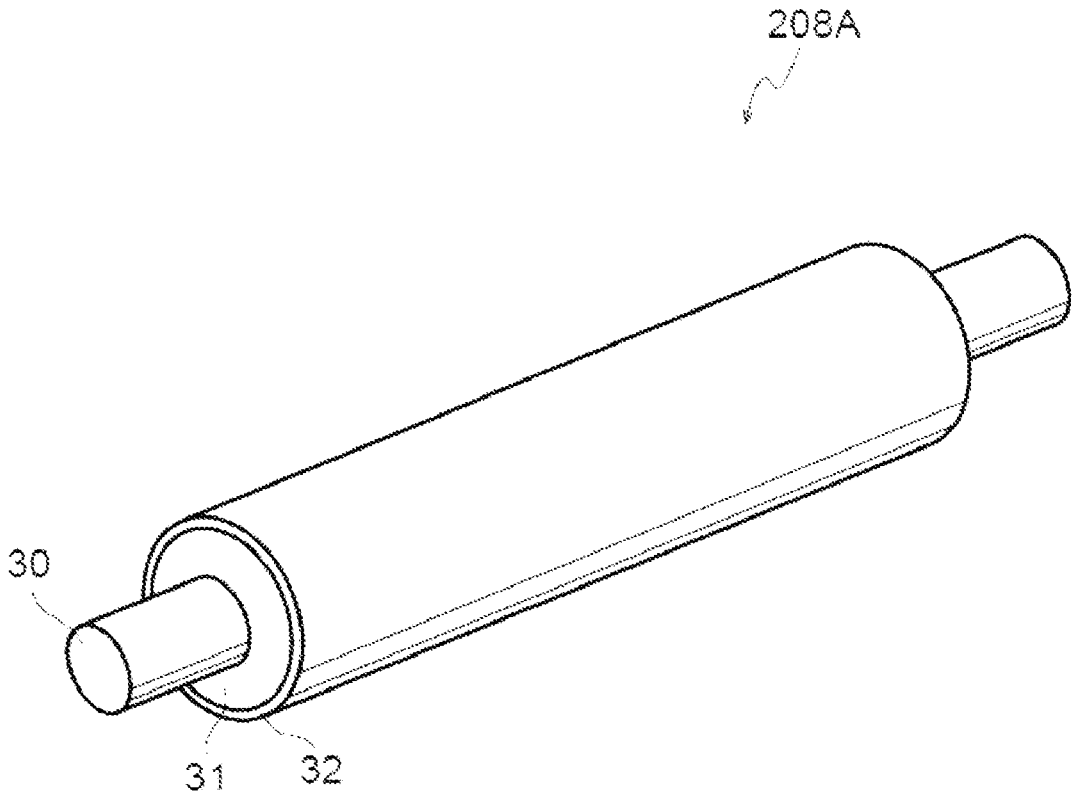
FIG. 2 is a schematic perspective view illustrating an example of the charging member in the exemplary embodiment.

FIG. 2 is a schematic perspective view illustrating an example of the charging member in the exemplary embodiment. A charging member 208A as illustrated in FIG. 2 includes a conductive substrate 30 which is a hollow or non-hollow cylindrical member, an elastic layer 31 disposed on the outer circumferential surface of the conductive substrate 30, and a surface layer 32 disposed on the outer circumferential surface of the elastic layer 31. The charging member 208A as illustrated in FIG. 2 is applied as the charging member 121 of the charging device 12 as illustrated in FIG. 1. As described above, the charging member in the exemplary embodiment is described with reference to FIG. 2, but the exemplary embodiment is not limited thereto.

In the charging member according to the exemplary embodiment, the distance Sm between irregularities in the axial direction on the surface of the surface layer is preferably 50 μm to 300 μm, and is more preferably 100 μm to 200 μm, from the viewpoint of preventing the occurrence of image streak failure.

In addition, in the charging member according to the exemplary embodiment, a protruding peak height Spk in the axial direction in the surface layer preferably satisfies $Spk \leq 5$ μm, more preferably satisfies $Spk \leq 4$ μm, and still more preferably satisfies $Spk \leq 3.5$ μm. A lower limit of the protruding peak height Spk is not particularly limited, and for example, it may be 2 μm or more (that is, Spk may satisfy $2\ \mu m \leq Spk \leq 5\ \mu m$). When the lower limit of Spk is 2 μm or more, the occurrence of the image streak failure is easily prevented. Further, when the protruding peak height Spk satisfies $Spk \leq 5$ μm, abrasion of the surface of the photoreceptor is easily prevented.

The distance Sm between irregularities is measured based on JIS B 0601:1994.

The distance Sm between irregularities is obtained in such a manner that a reference length is extracted from a roughness curve in the direction of an average line thereof, then a sum of the lengths of the average lines corresponding to one peak and one valley adjacent to the peak in the extracted portion, and an arithmetic mean value of intervals of a number of the irregularities is expressed in micrometers (μm). The measurement of the distance Sm between irregularities is performed using a contact-type surface roughness measuring apparatus (SURFCOM 570A, manufactured by Tokyo Seimitsu Co., Ltd.) in an environment of 23° C. and 55% RH. The measurement distance is set to 4 mm, and a contact needle is measured using a diamond tip (5 μmR, 90° cone), and then the average value is calculated. In a case of the axial direction, the distance Sm between irregularities is, for example, divided into six portions in the axial direction, and a value obtained by measuring a center portion of the six portions is an average value. In a case of the circumferential direction, the distance Sm between irregularities is, for example, divided into six portions in the circumferential direction at the center portion in the axial direction, and a value obtained by measuring a position at the center of the six portions is an average value.

The ten-point average roughness Rz is ten-point average roughness Rz measured based on JIS B 0601:1994. The measurement of the ten-point average roughness Rz is performed using a contact-type surface roughness measuring apparatus (SURFCOM 570A, manufactured by Tokyo Seimitsu Co., Ltd.) in an environment of 23° C. and 55% RH. The measurement distance is set to 2.5 mm, and a contact needle is measured using a diamond tip (5 μmR, 90° cone), and then the average value is calculated. In a case of the axial direction, the ten-point average roughness Rz is, for example, divided into six portions in the axial direction, and a value obtained by measuring a center portion of the six portions is an average value. In a case of the circumferential direction, the ten-point average roughness Rz is, for example, divided into six portions in the circumferential direction at the center portion in the axial direction, and a value obtained by measuring a position at the center of the six portions is an average value.

The protruding peak height Spk is a parameter representing three-dimensional surface properties defined in ISO 25178-2:2012, and calculated by a three-dimensional surface roughness profile. The average height of the protruding ridges above the core in the measured roughness curve of the surface. The protruding peak height Spk may be calculated by performing curved surface correction of the entire image and performing three-dimensional measurement from an image observed at a magnification of 20-fold, a measurement size of 2048×1536 pixels (0.34 μm/pixel), and a measurement pitch of 0.75 μm with a laser microscope (VK-X150, manufactured by Keyence Corporation), curved surface correction of the entire image is performed so as to calculate three-dimensional measurement. The protruding peak height Spk is measured at three different positions in the axial direction, and the average value thereof is calculated. The protruding peak height Spk is, for example, divided into three portions in the axial direction, and a value obtained by measuring a center portion of the three portions is an average value.

In the charging member according to the exemplary embodiment, when the ratio (Sm/Rz) of the Rz to the Sm in the circumferential direction is set as A, and the ratio (Sm/Rz) of the Rz to Sm in the axial direction in the axial direction is set as B, a ratio of A to B preferably satisfies $0.8 \leq A/B \leq 1.2$, and more preferably satisfies $0.9 \leq A/B \leq 1.1$, from the viewpoint of preventing the occurrence of image streak failure.

In the charging member according to the exemplary embodiment, the ratio (Sm/Spk) of Sm to Spk preferably satisfies $25 \leq Sm/Spk \leq 75$, and more preferably satisfies $40 \leq Sm/Spk \leq 70$, from the viewpoint of preventing the occurrence of image streak failure. The ratio Sm/Spk represents a ratio of Sm to Spk on the surface of the surface layer in the axial direction. Note that, when the ratio Sm/Spk is in a range of $25 \leq Sm/Spk \leq 75$, the abrasion of the image holding member is easily prevented.

It is more preferable that the charging member according to the exemplary embodiment contains irregularities-forming particle on the surface layer. By containing the irregularities-forming particle in the surface layer, it becomes easy to produce a charging member satisfying the range of Sm, the range of Sm/Rz, the Spk upper limit value, the range of A/B, and the range of Sm/Spk. In addition, by selecting the kinds and contents of the irregularities-forming particles, and formation temperature and time at the time of forming each layer, a target uneven shape may be formed in the surface layer, and the Sm/Rz ratio, the Spk, the A/B ratio, and the Sm/Spk ratio may be adjusted. These characteristics may be adjusted by the combination of the particle diameter of the irregularities-forming particle and the film thickness of the surface layer. Further, these characteristics may be adjusted by containing the irregularities-forming particle in the surface layer, and adjusting the ten-point average roughness Rz2 of the elastic layer in the axial direction.

The material for the irregularities-forming particle contained in the surface layer is not particularly limited, and it may be an inorganic particle or an organic particle. Specific examples of the irregularities-forming particle contained in the surface layer include an inorganic particle such as a silica particle, an alumina particle, and a zircon ($ZrSiO_4$) particle, and a resin particle such as a polyamide particle, a fluoro resin particle, and a silicone resin particle. Among them, the irregularities-forming particle contained in the surface layer is more preferably a resin particle, and is still more preferably a polyamide particle, from the viewpoint of preventing the occurrence of image streak failure. The irregularities-forming particle may be contained alone or two or more kinds thereof may be contained in the surface layer.

In addition, as the irregularities-forming particle, the surface layer preferably contains irregularities-forming particles having a volume average particle diameter of 5 μm to 20 μm in an amount of 5 parts by weight to 30 parts by weight with respect to 100 parts by weight of a binder resin contained in the surface layer, from the viewpoint of preventing the occurrence of image streak failure. Further, the surface layer more preferably contains the irregularities-forming particle having the volume average particle diameter of 8 μm to 15 μm in an amount of 8 parts by weight to 20 parts by weight with respect to 100 parts by weight of a binder resin.

In the method of measuring the volume average particle diameter of the particles in the exemplary embodiment, a sample obtained by cutting a layer is used, the sample is observed with an electron microscope, the diameters (maximum diameter) of 100 particles is measured, and the measured diameters are volume-averaged to calculate the volume average particle diameter. In addition, the average particle diameter may be measured, for example, using Zetasizer Nano ZS manufactured by Sysmex Corporation.

In a case where the charging member according to the exemplary embodiment contains the irregularities-forming particle in the surface layer, it may contain a surface layer alone, or may contain both layers of the surface layer and the elastic layer.

[Conductive Substrate]

The conductive substrate functions as an electrode and a support of the charging member. Examples of the conductive substrate include conductive materials such as metal or an alloy such as aluminum, a copper alloy, and stainless steel; iron plated with chromium, nickel or the like; and a conductive resin. The conductive substrate in the exemplary embodiment functions as an electrode and a support member of the charging roll, and examples of materials thereof include metals such as iron (free cutting steel etc.), copper, brass, stainless steel, aluminum, and nickel. In the exemplary embodiment, the conductive substrate is a conductive rod-shaped member, and examples of the conductive substrate include a member (for example, a resin or a ceramic member) of which the outer circumferential surface is plated, a member (for example, a resin or a ceramic member)

in which a conductive agent is dispersed. The conductive substrate may be a hollow member (cylindrical member) or a non-hollow member.

[Elastic Layer]

The elastic layer is, for example, a conductive layer including an elastic material and a conductive agent. The elastic layer may contain other additives as needed.

The elastic layer may be a single layer or a laminate of plural layers. The elastic layer may be a conductive foamed elastic layer, a conductive non-foamed elastic layer, or may be a laminate of the conductive foamed elastic layer and the conductive non-foamed elastic layer.

Examples of the elastic material include polyurethane, a nitrile rubber, an isoprene rubber, a butadiene rubber, an ethylene-propylene rubber, an ethylene-propylene-diene rubber, an epichlorohydrin rubber, an epichlorohydrin-ethylene oxide rubber, an epichlorohydrin-ethylene oxide-allyl glycidyl ether rubber, a styrene-butadiene rubber, an acrylonitrile-butadiene rubber, a chloroprene rubber, a chlorinated polyisoprene, a hydrogenated polybutadiene, a butyl rubber, a silicone rubber, a fluororubber, a natural rubber, and an elastic material mixed with these. Among these elastic materials, polyurethane, a silicone rubber, a nitrile rubber, an epichlorohydrin rubber, an epichlorohydrin-ethylene oxide rubber, an epichlorohydrin-ethylene oxide-allyl glycidyl ether rubber, an ethylene-propylene-diene rubber, an acrylonitrile-butadiene rubber, and an elastic material mixed with these may be preferable.

As the conductive agent, an electron conductive agent or an ion conductive agent is exemplified. Examples of the electron conductive agent include powders such as carbon black such as furnace black, thermal black, channel black, ketjen black, acetylene black, and color black; pyrolytic carbon; graphite; metals or alloys such as aluminum, copper, nickel, and stainless steel; metal oxides such as tin oxide, indium oxide, titanium oxide, a tin oxide-antimony oxide solid solution, and a tin oxide-indium oxide solid solution; and a material obtained by performing a conductive treatment on a surface of an insulating material. In addition, examples of the ion conductive agent include perchlorates or chlorates such as tetraethyl ammonium, lauryl trimethyl ammonium, and benzyl trialkyl ammonium; alkaline metals such as lithium and magnesium; and perchlorate or chlorate such as alkaline earth metal. The conductive agents may be used alone or in combination of two or more kinds thereof. The conductive agent has an average primary particle diameter which is preferably 1 nm to 200 nm, for example.

The content of the electron conductive agent in the elastic layer is preferably 1 part by weight to 30 parts by weight, and is more preferably 15 parts by weight to 25 parts by weight with respect to 100 parts by weight of the elastic material. The content of the ion conductive agent in the elastic layer is preferably 0.1 parts by weight to 5 parts by weight, and is more preferably 0.5 parts by weight to 3 parts by weight with respect to 100 parts by weight of the elastic material. In addition, an average particle diameter is calculated by observing a sample obtained by cutting out the elastic layer with an electron microscope, measuring diameters (maximum diameter) of 100 conductive agents, and then averaging the measured diameters. In addition, the average particle diameter may be measured, for example, using Zetasizer Nano ZS manufactured by Sysmex Corporation.

The content of the conductive agent is not particularly limited, and in a case of the above electron conductive agent, it is preferably 1 part by weight to 30 parts by weight, and is more preferably 15 parts by weight to 25 parts by weight, with respect to 100 parts by weight of the elastic material. On the other hand, in a case of the ion conductive agent, it is preferably 0.1 parts by weight to 5.0 parts by weight, and is more preferably 0.5 parts by weight to 3.0 parts by weight, with respect to 100 parts by weight of the elastic material.

Examples of other additives to be mixed to the elastic layer include a softener, a plasticizer, a curing agent, a vulcanizing agent, a vulcanization accelerator, a vulcanization accelerating auxiliary agent, an antioxidant, a surfactant, a coupling agent, a filler (such as silica, calcium carbonate, and clay mineral).

The thickness of the elastic layer is preferably 1 mm to 10 mm, and is more preferably 2 mm to 5 mm. The volume resistivity of the elastic layer is preferably $1\times10^{3}$ Ωcm to $1\times10^{14}$ Ωcm.

Note that, the volume resistivity of the elastic layer is a value measured by the following method. A sheet-shaped measurement sample is taken from the elastic layer, a voltage adjusted such that the electric field (applied voltage/composition sheet thickness) becomes 1000 V/cm is applied to the measurement sample for 30 seconds by using a measurement jig (R12702A/B resistivity chamber: manufactured by Advantest Corporation) and a high resistance measuring instrument (R8340A digital high resistance/icroammeter: manufactured by Advantest Corporation) in accordance with JIS K 6911(1995), and from the current value, calculation is performed using the following equation.

Volume resistivity (Ωcm)=(19.63×applied voltage (V))/(current value (A)×thickness of measurement sample (cm))

In the elastic layer, in the surface on the surface layer side (that is, a front surface of the elastic layer excluding the surface layer), ten-point average roughness Rz2 in the axial direction preferably satisfies $3\leq Rz2\leq 10$, from the viewpoint of preventing the occurrence of the image streak failure. The Rz2 is more preferably satisfies $3.5\leq Rz2\leq 8$, and is still more preferably satisfies $4\leq Rz2\leq 7$.

In order to control the Rz2 to be in the above range, for example, the elastic layer is formed on the conductive substrate, and then polishing conditions for the elastic layer surface are adjusted.

In a method of measuring the Rz2, first, the elastic layer is exposed by being dissolved in an organic solvent (for example, an alcohol solvent such as methanol) capable of removing the surface layer of the charging member to be measured. Then, the surface of the exposed elastic layer is measured by the same method as the method of measuring the ten-point average roughness Rz described above.

Examples of method of forming the elastic layer on the conductive substrate include a method of forming a layer of an elastic layer forming composition on the outer circumferential surface of the conductive substrate by co-extruding an elastic layer forming composition in which an elastic material, a conductive agent, and other additives are mixed and a cylindrical conductive substrate with an extruder, and then heating and crosslinking the layer of the elastic layer forming composition so as to form an elastic layer; and a method of forming a layer of an elastic layer forming composition on the outer circumferential surface of the conductive substrate by extruding an elastic layer forming composition in which an elastic material, a conductive agent, and other additives are mixed to the outer circumferential surface of an endless belt-shaped conductive substrate, and then heating and crosslinking the layer of the elastic layer forming composition so as to form an elastic layer. The conductive substrate may have an adhesive layer on the outer circumferential surface thereof.

[Surface Layer]

The charging member according to the exemplary embodiment further includes a surface layer on the elastic layer. The surface layer is, for example, a layer containing a resin. The surface layer may contain other additives or the like as needed. Examples of the binder resin that may be used for the surface layer include a urethane resin, polyester, phenol, acrylic, polyurethane, an epoxy resin, and cellulose. In order to adjust the resistivity of the surface layer to an appropriate value, a conductive particle is contained in many cases. The conductive particle preferably has a particle diameter of 3 μm or less and a volume resistivity of $10^9$ Ω cm or less. For example, a particle consisting of a metal oxide such as tin oxide, titanium oxide, or zinc oxide, or an alloy thereof, or carbon black may be used.

The thickness of the surface layer is preferably 2 μm to 10 μm, and is more preferably 3 μm to 8 μm. The volume resistivity of the surface layer is preferably $1\times10^5$ Ωcm to $1\times10^8$ Ωcm.

As a method of applying the surface layer, a general method such as a roll coating method, a blade coating method, a wire bar coating method, a spraying method, a dip coating method, a bead coating method, an air knife coating method, and a curtain coating method may be used. The roll coating method is preferably applied to the present invention in which the vicinity of the end portion is thicker than the vicinity of the center portion because end dripping does not occur. In addition, the dip coating method is preferably applied to the present invention because it may efficiently form a film with few defects even with the occurrence of end dripping.

[Adhesive Layer]

The charging member according to the exemplary embodiment may include an adhesive layer between the conductive substrate and the elastic layer. As an adhesive layer interposed between the elastic layer and the conductive substrate, a resin layer may be mentioned, and specific examples thereof include a resin layer of polyolefin, an acrylic resin, an epoxy resin, a polyurethane, a nitrile rubber, a chlorine rubber, a vinyl chloride resin, a vinyl acetate resin, polyester, a phenol resin, and a silicone resin may be mentioned. The adhesive layer may contain a conductive agent (for example, the electron conductive agent or ion conductive agent).

The thickness of the adhesive layer is preferably 1 μm to 100 μm, is more preferably 2 μm to 50 μm, and is particularly preferably 5 μm to 20 μm, from the viewpoint of adhesion.

(Clean Member)

The clean member in the exemplary embodiment will be described. The clean member in the exemplary embodiment includes a foamed elastic layer. Specifically, a shaft and a foamed elastic layer provided on the outer circumferential surface of the shaft portion are provided. The foamed elastic layer may be disposed so as to cover the entire surface of an area in contact with the body to be cleaned (that is, the charging member according to the exemplary embodiment) of the outer circumferential surface of the shaft, and may be disposed spirally wound around the shaft from one end to the other end thereof. From the viewpoint of preventing the occurrence of image streak failure, the clean member preferably includes a shaft and a foamed elastic layer spirally disposed from one end portion side to the other end portion side of the shaft.

Figure 3:
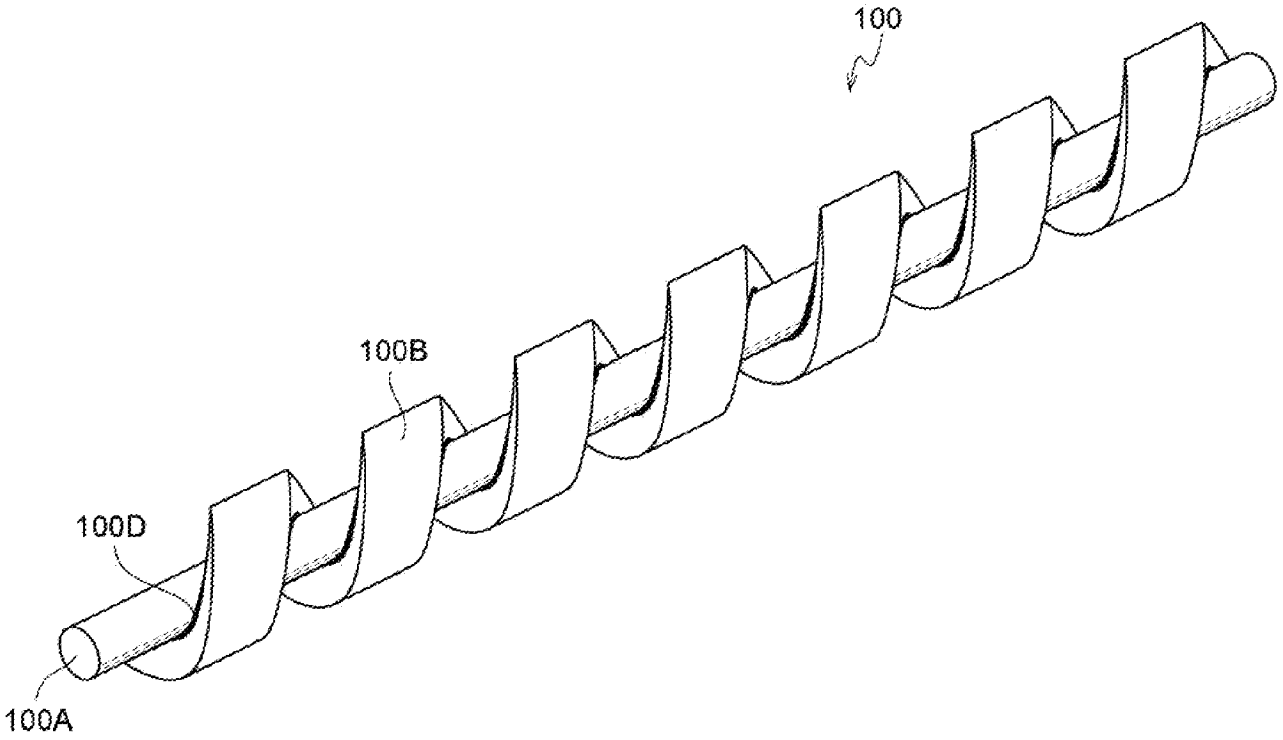
FIG. 3 is a schematic configuration diagram illustrating an example of a clean member in the exemplary embodiment.
Figure 4:
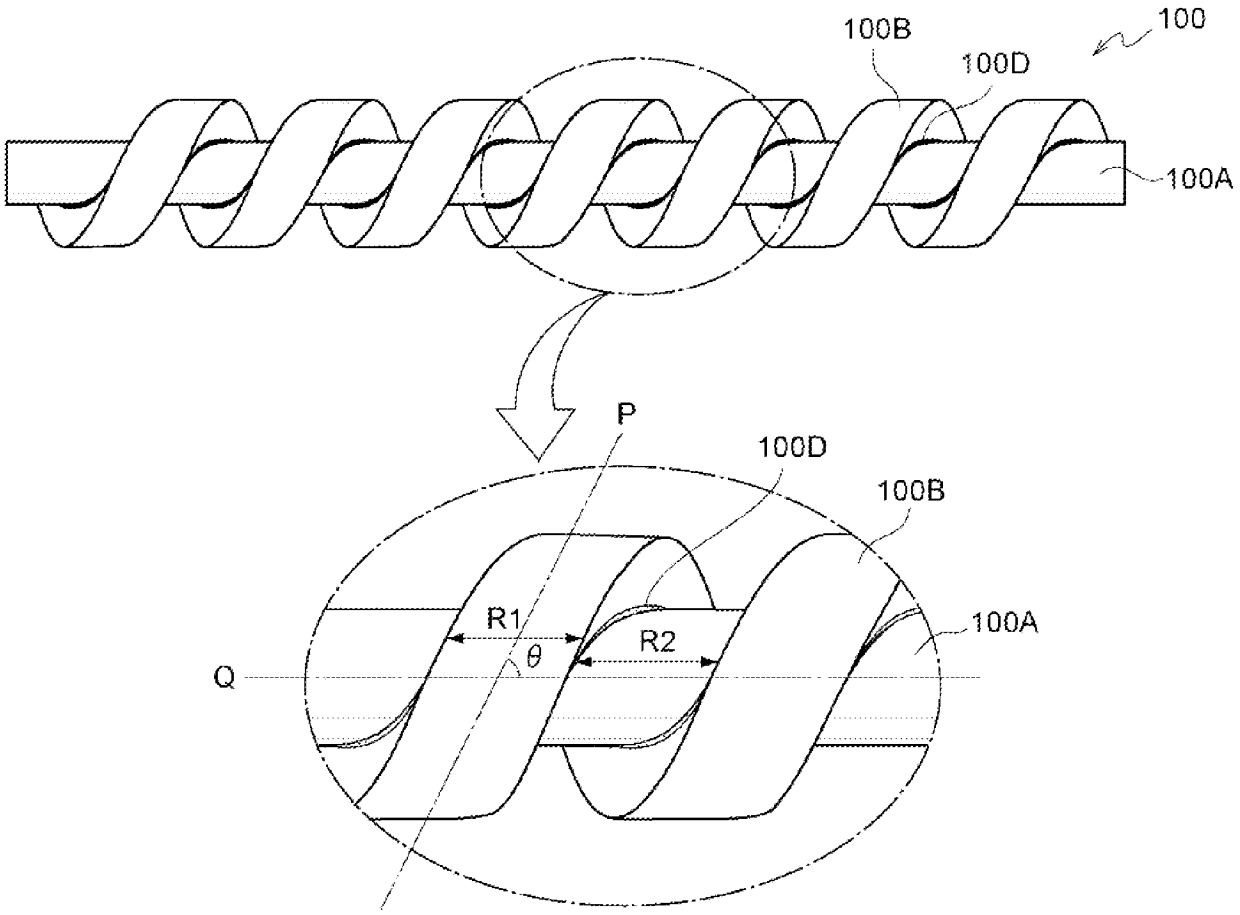
FIG. 4 is a schematic configuration diagram illustrating an example of the clean member in the exemplary embodiment.

FIG. 3 is a schematic configuration diagram illustrating an example of the clean member in the exemplary embodiment, and is a schematic perspective view. FIG. 4 is a schematic configuration diagram illustrating an example of the clean member in the exemplary embodiment, and is a plan view.

The clean member 100 (an example of the clean member) illustrated in FIGS. 3 and 4 is provided with a core 100A (an example of a shaft) and a foamed elastic layer 100B (an example of a foamed elastic layer) which is provided on the outer circumferential surface of the core 100A and is in contact with the charging member (for example, a charging member 121 illustrated in FIG. 1). In addition to the core 100A and the foamed elastic layer 100B, the clean member 100 includes an adhesive layer 100D which bonds the core 100A and the foamed elastic layer 100B, and is set as a roll-shaped member.

[Core 100A]

As a material used for the core 100A, metal (for example, free-cutting steel, stainless steel, or the like) or a resin (for example, a polyacetal resin (POM)) may be exemplified. Note that, it is preferable to select a material and a surface treatment method as needed.

In particular, in a case where the core 100A is made of metal, it is preferable to perform a plating treatment. In addition, in a case where a resin or the like does not have conductivity, it may be processed by a general treatment such as the plating treatment so as to conduct a conductivity treatment, or may be used as it is.

[Adhesive Layer 100D]

The adhesive layer 100D is not particularly limited as long as it may bond the core 100A and the foamed elastic layer 100B, and is made of, for example, a double-sided tape or another adhesive.

[Foamed Elastic Layer 100B]

The foamed elastic layer 100B is made of a material (so-called foamed body) with air bubbles. The specific material of the foamed elastic layer 100B will be described later.

Figure 6:
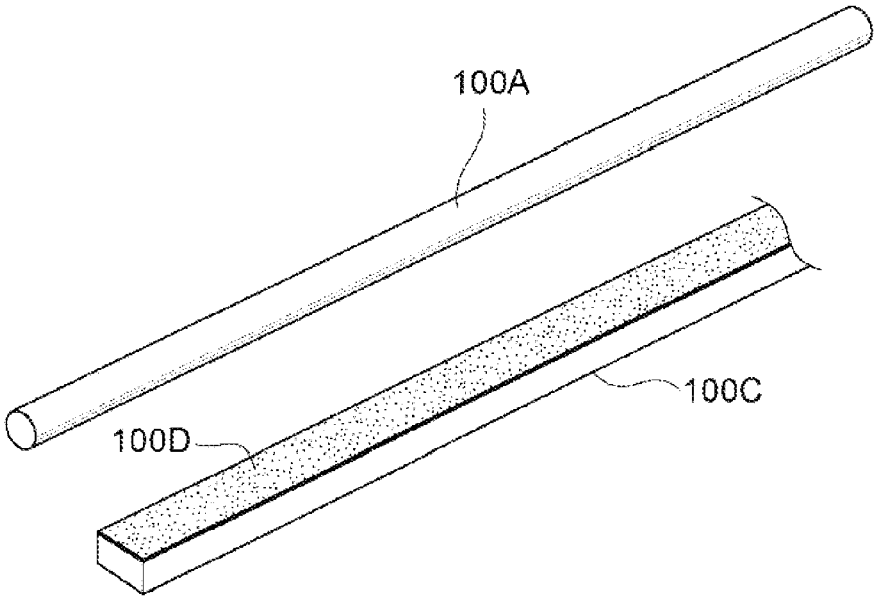
FIG. 6 is a process drawing illustrating a process in an example of a method of manufacturing a clean member in the exemplary embodiment.
Figure 7:
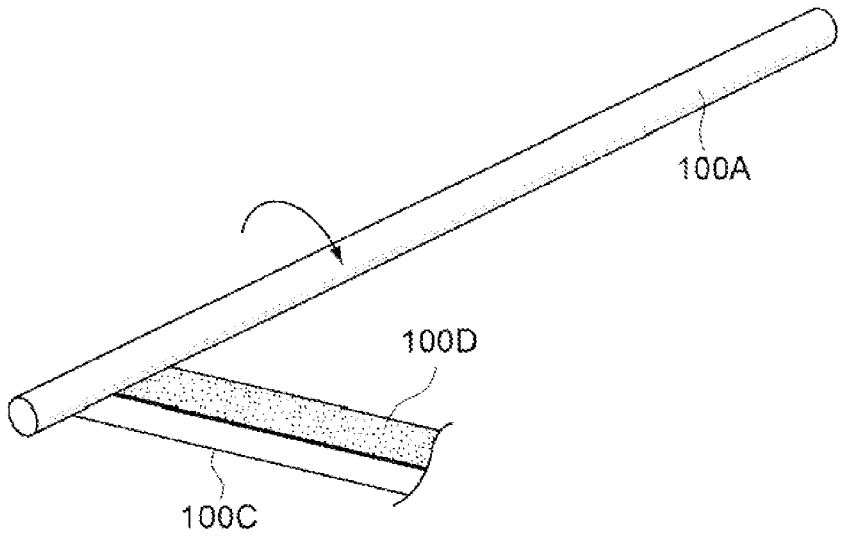
FIG. 7 is a process drawing illustrating a process in an example of the method of manufacturing a clean member in the exemplary embodiment.
Figure 8:
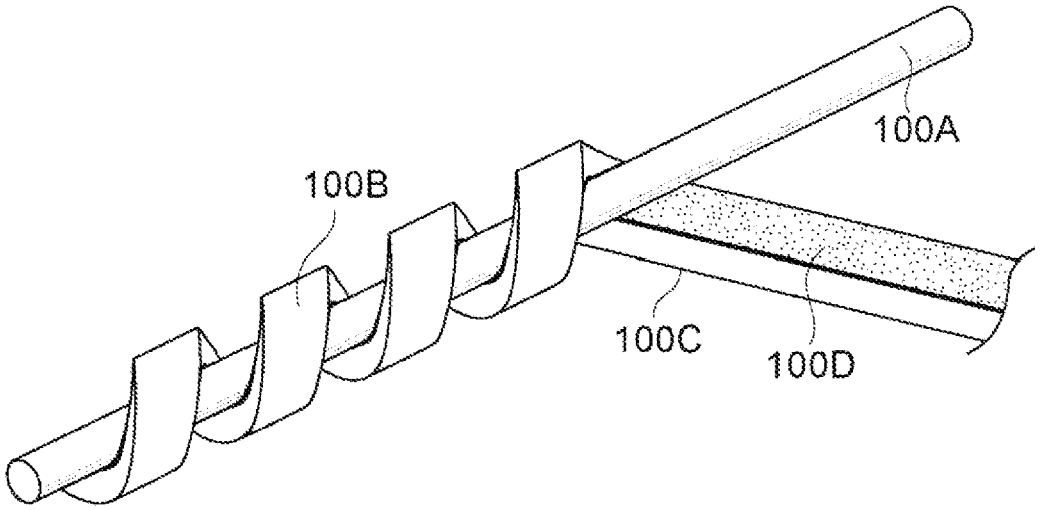
FIG. 8 is a process drawing illustrating a process in an example of the method of manufacturing a clean member in the exemplary embodiment.

As illustrated in FIGS. 3 and 4, the foamed elastic layer 100B is disposed by being spirally wound around the outer circumferential surface of the core 100A from one axial end to the other axial end of the core 100A. Specifically, as illustrated in FIGS. 6 to 8, the foamed elastic layer 100B is formed such that the core 100A is set as a spiral shaft from one axial end to the other axial end of the core 100A, and a strip-shaped foamed elastic member 100C (hereinafter, may be referred to as a strip 100C) is formed to be spirally wound around the core 100A with intervals.

Figure 5:
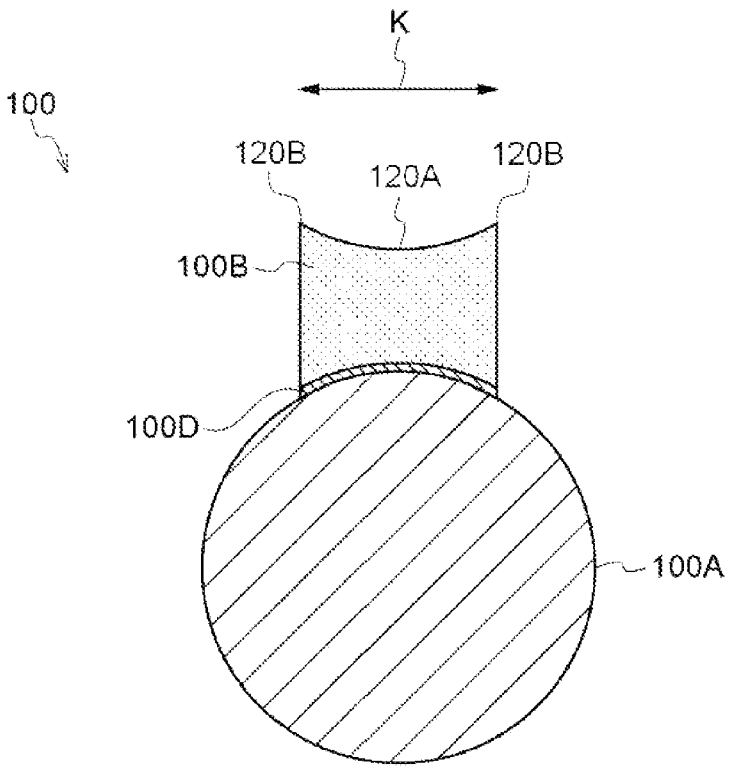
FIG. 5 is a schematic sectional view illustrating the clean member in an axial direction in the exemplary embodiment.

FIG. 5 is a schematic sectional view illustrating the clean member in an axial direction according to the exemplary embodiment. As illustrated in FIG. 5, the foamed elastic layer 100B has a quadrilateral shape surrounded by four sides (including a curve) on a cross section of the core 100A in the axial direction, and includes a protruding portion 120B which is provided at both end portions of the foamed elastic layer 100B in the axial direction (K direction), and protrudes radially outward of the core 100A from the center portion 120A. The protruding portion 120B is formed along the longitudinal direction of the foamed elastic layer 100B.

Then, when the protruding portion 120B applies, for example, tension to the foamed elastic layer 100B in the longitudinal direction, an outer diameter difference is generated and formed in the center portion 120A of the outer circumferential surface of the foamed elastic layer 100B in the width direction and the both end portions in the width direction. Here, in the exemplary embodiment, the range of the protruding portion 120B refers to a range of up to 10% from one end side to the other end side of the distance in the K direction measured along the surface of the elastic layer curved in a recess shape. Moreover, the range of the center portion 120A refers to a part except the range of the protruding portion 120B at both ends in the K direction.

The thickness (thickness at the center portion in the width direction) of the foamed elastic layer 100B may, for example, 1.0 mm to 3.0 mm, is preferably 1.4 mm to 2.6 mm, and is more preferably 1.6 mm to 2.4 mm.

The thickness of the foamed elastic layer 100B is measured, for example, as follows.

Using a laser measuring machine (laser scanning micrometer, manufactured by Mitutoyo Corporation), a profile of the thickness of the foamed elastic layer (foamed elastic layer thickness) is measured by scanning the foamed elastic layer in the longitudinal direction (axial direction) of the clean member at a traverse speed of 1 mm/s in a state where the circumferential direction of the clean member is fixed. After that, the same measurement is performed by shifting the position in the circumferential direction (the position in the circumferential direction is located at three points at 1200 intervals). The thickness of the foamed elastic layer 100B is calculated based on this profile.

The foamed elastic layer 100B is spirally disposed, and specifically, for example, a spiral angle θ is 5° to 70° (preferably, 10° to 65°, more preferably 10° to 60°, and still more preferably 15° to 50°), and a spiral width R1 may be 3 mm to 25 mm (preferably 3 mm to 10 mm). A spiral pitch R2 may be, for example, 3 mm to 25 mm (preferably 15 mm to 22 mm) (refer to FIG. 4).

The foamed elastic layer 100B may have a coverage ratio (spiral width R1 of foamed elastic layer 100B/[spiral width R1 of foamed elastic layer 100B+spiral pitch R2 of foamed elastic layer 100B: (R1+R2)]) which is 20% to 70%, and is preferably 25% to 55%.

When the coverage ratio is larger than the above range, the time during which the foamed elastic layer 100B is in contact with the body to be cleaned becomes longer, and thus the deposits attached to the surface of the clean member are more likely to re-contaminate the body to be cleaned; however, when the coverage ratio is smaller than the above range, the thickness of the foamed elastic layer 100B becomes difficult to stabilize, and the cleaning ability tends to be deteriorated.

The spiral angle θ means an angle (acute angle) at which a longitudinal direction P (a spiral direction) of the foamed elastic layer 100B intersects with an axial direction Q (a core axial direction) of the core 100A (refer to FIG. 4).

The spiral width R1 means the length of the foamed elastic layer 100B along the axial direction Q (the core axial direction) of the clean member 100.

The spiral pitch R2 means the length between adjacent foamed elastic layers 100B along the axial direction Q (the core axis direction) of the clean member 100 of the foamed elastic layer 100B.

In addition, the foamed elastic layer 100B refers to a layer made of a material that restores its original shape even when deformed by the application of an external force of 100 Pa.

[Material of Foamed Elastic Layer 100B]

Examples of the material for the foamed elastic layer 100B include one selected from foamable resins (polyurethane, polyethylene, polyamide, and polypropylene) and rubber materials (a silicone rubber, a fluorine rubber, and a urethane rubber, EPDM (an ethylene.propylene.diene rubber), NBR (an acrylonitrile-butadiene copolymer rubber), CR (a chloroprene rubber), a chlorinated polyisoprene rubber, an isoprene rubber, an acrylonitrile-butadiene rubber, a styrene-butadiene rubber, a hydrogenated polybutadiene rubber, and a butyl rubber), and materials obtained by blending two or more thereof.

In addition, an auxiliary agent such as a foaming auxiliary agent, a foam regulating agent, a catalyst, a hardening agent, a plasticizer, or a vulcanization accelerator may be added as needed.

Particularly, the foamed elastic layer 100B is preferably a polyurethane foam that is resistant to tension, from the viewpoint of preventing scratches to the surface of the body to be cleaned (for example, the charging member 121 as illustrated in FIG. 1) due to rubbing, and preventing breakage or damage for a long time of period.

As polyurethane, for example, a reactant of polyol (for example, polyester polyol, polyether polyol, polyester, and acrylic polyol) with isocyanate (for example, 2,4-tolylene diisocyanate, 2,6-tolylene diisocyanate, 4,4-diphenylmethane diisocyanate, tolylene diisocyanate, and 1,6-hexamethylene diisocyanate), is exemplified and a material containing a chain extender (1,4-butanediol or trimethylolpropane) may be exemplified.

Foaming of polyurethane is generally performed using a foaming agent such as water or an azo compound (for example, azodicarbonamide and azobisisobutyronitrile).

The foamed polyurethane may be added with an auxiliary agent such as a foaming auxiliary agent, a foam control agent, and a catalyst, as needed.

The number of cells of the foamed elastic layer 100B which is calculated based on JIS K 6400-1: 2004 (Appendix 1) is preferably 80 cells/25 mm to 105 cells/25 mm, and is more preferably 85 cells/25 mm to 100 cells/25 mm, from the viewpoint of preventing the occurrence of image streak failure. Moreover, it is more preferable that the density of the foamed elastic layer is 60 kg/m$^3$ to 100 kg/m$^3$ from the same point.

[Configuration of Foamed Elastic Layer 100B]

In the clean member in the exemplary embodiment, the number of the cells is preferably 80 cells/25 mm to 105 cells/25 mm, and the spiral angle is preferably is 5° to 70°. From the same point of view, it is more preferable that the number of cells is 85 cells/25 mm to 100/25 mm, and the spiral angle is 10° to 60°.

In the clean member in the exemplary embodiment, when W is set as a width of a nodal section of a foam cell wall surface of the elastic layer, the width W of the nodal section of the foam cell wall surface is preferably 30 μm to 50 μm, and is more preferably 35 μm to 45 μm, from the viewpoint of preventing the occurrence of image streak failure.

In the present specification, "the width of the nodal section of the foam cell wall surface of the elastic layer" is defined as follows. When the foamed elastic layer of the clean member is observed by a method of measuring the width W of the nodal section of the foam cell wall surface shown below, a length of each side of the protruding triangular area formed by the foam cell wall surface of the foamed elastic layer (that is, the portion to be the skeleton forming the foam cell of the foamed elastic layer) is measured, and the resultant obtained by calculating the average of the length of each side of the measured triangular area is set as "the width of the nodal section of the foam cell wall surface of an elastic layer".

The width W of the nodal section of the foam cell wall surface is measured using a confocal microscope (OPTELICS HYBRID, manufactured by Lasertec Corporation) to measure the width of the nodal section of the foam cell wall surface. An observation image of 1386 μm×1038 μm square is captured at three locations, and the average value obtained by measuring all widths of nodal sections in the observation image is used.

The width W of the nodal section of the foam cell wall surface does not necessarily satisfy the above range simply by adjusting a cell diameter. The width W of the nodal section of the foam cell wall surface may satisfy by adjusting various conditions such as a cell diameter of the foamed elastic layer, a density of the foamed elastic layer, a structure of the foamed elastic layer, a polishing treatment of the foamed elastic layer surface.

From the viewpoint of preventing the occurrence of image streak failure, the width W of the nodal section of the foam cell wall surface is preferably 30 μm to 50 μm, and the density of the foamed elastic layer is preferably 60 kg/m$^3$ to 100 kg/m$^3$, the width W of the nodal section of the foam cell wall surface is preferably 30 μm to 50 μm, and the density of the foamed elastic layer is 70 kg/m$^3$ to 90 kg/m$^3$. Note that, the density of the foamed elastic layer is measured by cutting out the foamed elastic layer in accordance with JIS K 7222:2005.

In the foamed elastic layer 100B, the relationship between the line roughness RaE of the protruding portion and the line roughness RaV of the center portion satisfies RaE/RaV≥5. From the viewpoint of preventing the occurrence of image streak failure (particularly, from the viewpoint of enhancing the cleaning performance with respect to the body to be cleaned with a larger details of surface irregularities), RaE/RaV≥6 is preferable and RaE/RaV≥7 is more preferable. Further, the upper limit of RaE/RaV is not particularly limited, and may be, for example, 15 or less.

From the viewpoint of preventing the occurrence of image streak failure, the line roughness RaE of the protruding portion is preferably 20 or more, and is more preferably 50 or more. Further, the upper limit of RaE is not particularly limited, and may be, for example, 100 or less.

From the viewpoint of preventing the occurrence of image streak failure, the line roughness RaV of the center portion is preferably 5 or more, and is more preferably 7 or more. Further, the upper limit of RaV is not particularly limited, and may be, for example, 20 or less.

The line roughness RaE of the protruding portion and the line roughness RaV of the center portion may be controlled by a material type of the elastic layer, a foaming density and structure, and a width (spiral width) when the elastic layer is wound around a core (an example of a shaft) and a winding angle (spiral angle).

Here, the line roughness RaE of the protruding portion and the line roughness RaV of the center portion are measured as follows. First, both ends of the shaft of the clean member to be measured are mounted and fixed on a V-shaped block on a measurement table of a laser microscope (VK; manufactured by Keyence Corporation). Next, the surface of the elastic layer is directly observed to obtain an analysis image. Then, the line roughness of the protruding portion calculated from the image analysis by this measurement is taken as an index of RaE, and the line roughness of the center portion is taken as an index of RaV. Specifically, it is performed as follows. The surface (measurement area (100 μm×100 μm)) of the elastic layer to be measured is scanned at a pitch of 0.01 μm in the depth direction with a 100-fold objective lens, and from the obtained image data, measurement is made at six locations in a 10 μm square area, and the average value of the measured six locations is calculated. Each of RaE and RaV are measured.

(Method of Manufacturing Clean Member 100)

Next, a method of manufacturing the clean member 100 an example of the clean member in the exemplary embodiment will be described. FIGS. 6 to 8 are process drawings illustrating a process in an example of a method of manufacturing the clean member 100 according to the exemplary embodiment.

First, as illustrated in FIG. 6, a sheet-shaped foamed elastic member (foamed polyurethane sheet or the like) sliced to a target thickness is prepared, the member is punched out by a punching die, and a width and length of a target sheet.

A double-sided tape 100D is attached to one side of this sheet-shaped foamed elastic member to obtain a strip 100C (a strip-shaped foamed elastic member with the double-sided tape 100D) having a target width and length.

Next, as illustrated in FIG. 7, the strip 100C is disposed with the surface with the double-sided tape 100D facing upward, in this state, one end of release paper of the double-sided tape 100D is peeled off, and one end portion of the core 100A is placed on the double-sided tape with the release paper peeled off.

Next, as illustrated in FIG. 8, while peeling off the release paper of the double-sided tape, the core 100A is rotated at a target speed to spirally wind the strip 100C around the outer circumferential surface of the core 100A so as to obtain the clean member 100 including the foamed elastic layer 100B spirally disposed on the outer circumferential surface of the core 100A.

Here, when the strip 100C to be the foamed elastic layer 100B is wound around the core 100A, the strip 100C may be positioned such that the longitudinal direction of the strip 100C is a target angle (a spiral angle) with respect to the axial direction of the core 100A. The outer diameter of the core 100A may be 3 mm to 6 mm, for example.

The tension applied when winding the strip 100C around the core 100A is preferably such that no gap is generated between the core 100A and the double-sided tape 100D of the strip 100C, and it is preferable not to apply an excessive tension. When the tension is excessively applied, tensile permanent elongation tends to be increased and the elastic force of the foamed elastic layer 100B necessary for cleaning tends to be deteriorated. Specifically, for example, the tension may be set to the elongation falling within the range of more than 0% and 5% or less with respect to the length of the original strip 100C.

On the other hand, when the strip 100C is wound around the core 100A, the strip 100C tends to be elongated. This elongation differs in the thickness direction of the strip 100C, and the outermost portion tends to be most elongated, and the elastic force may be deteriorated. Therefore, it is preferable that the elongation of the outermost portion after winding the strip 100C around the core 100A is about 5% with respect to the outermost portion of the original strip 100C.

The elongation is controlled by the radius of curvature at which the strip 100C is wound around the core 100A and the thickness of the strip 100C, and the radius of curvature at which the strip 100C is wound around the core 100A is controlled by the outer diameter of the core 100A and the winding angle (spiral angle θ) of the strip 100C.

The radius of curvature at which the strip 100C is wound around the core 100A may be, for example, ((core outer diameter/2)+0.2 mm) to ((core outer diameter/2)+8.5 mm), and is preferably ((core outer diameter/2)+0.5 mm) to ((core outer diameter/2)+7.0 mm).

The thickness of the strip 100C may be, for example, 1.5 mm to 4 mm, and is preferably 1.5 mm to 3.0 mm. In addition, the width of the strip 100C may be adjusted such that the coverage ratio of the foamed elastic layer 100B is in the above range. Further, the length of the strip 100C is determined by, for example, the axial length of the area to be wound around the core 100A, the winding angle (the spiral angle θ), and the tension at the time of winding.

[Action of Clean Member]

Next, the action of the clean member will be described.

In the exemplary embodiment, a foreign matter such as a developer remaining on the photoreceptor (an example of the image holding member) without being transferred to the recording medium is removed from the photoreceptor by a cleaning blade. Some foreign matters such as a developer that has slipped through the cleaning blade without being removed by the cleaning blade are attached to the surface of the charging member.

The protruding portion and the outer circumferential surface of the foamed elastic layer (an upper surface in FIG. 5) contacts the charging member, and the outer circumferential surface of the charging member is wiped therewith, so that foreign matters attached to the surface of the charging member are removed.

(Modification of Clean Member)

Figure 9:
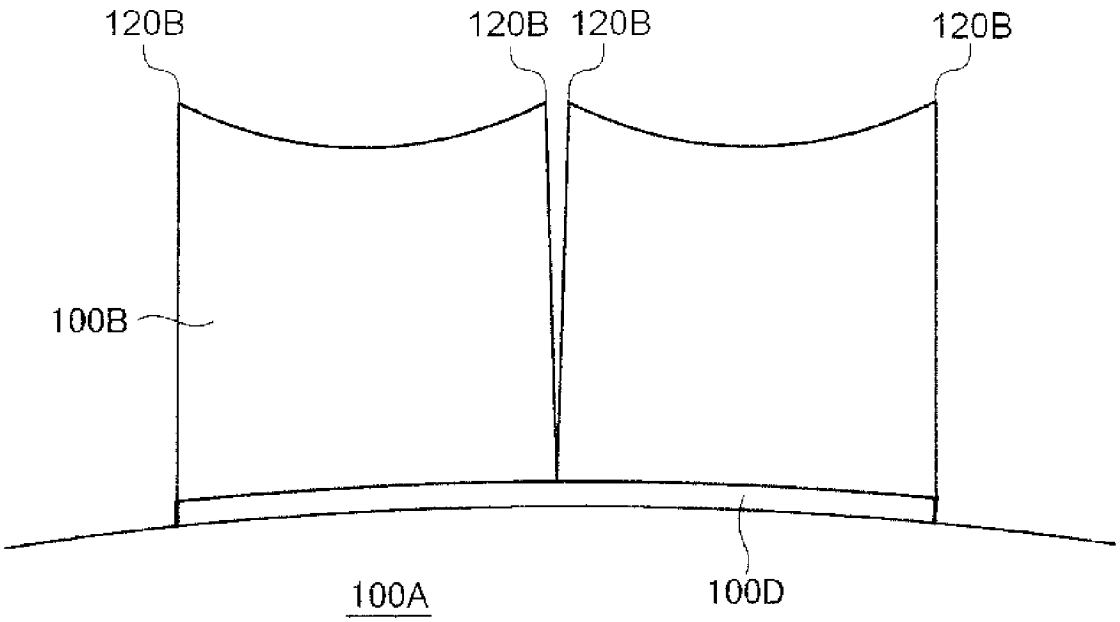
FIG. 9 is an enlarged sectional view illustrating an example of a foamed elastic layer in the clean member in another exemplary embodiment.

The foamed elastic layer is not limited to the configuration of one strip. For example, when referring to FIGS. 9 and 10, as illustrated in FIGS. 9 and 10, the foamed elastic layer 100B may be configured to include at least two or more strips 100C (strip-shaped foamed elastic members), in which the two or more strips 100C are spirally disposed on the core 100A.

Figure 10:
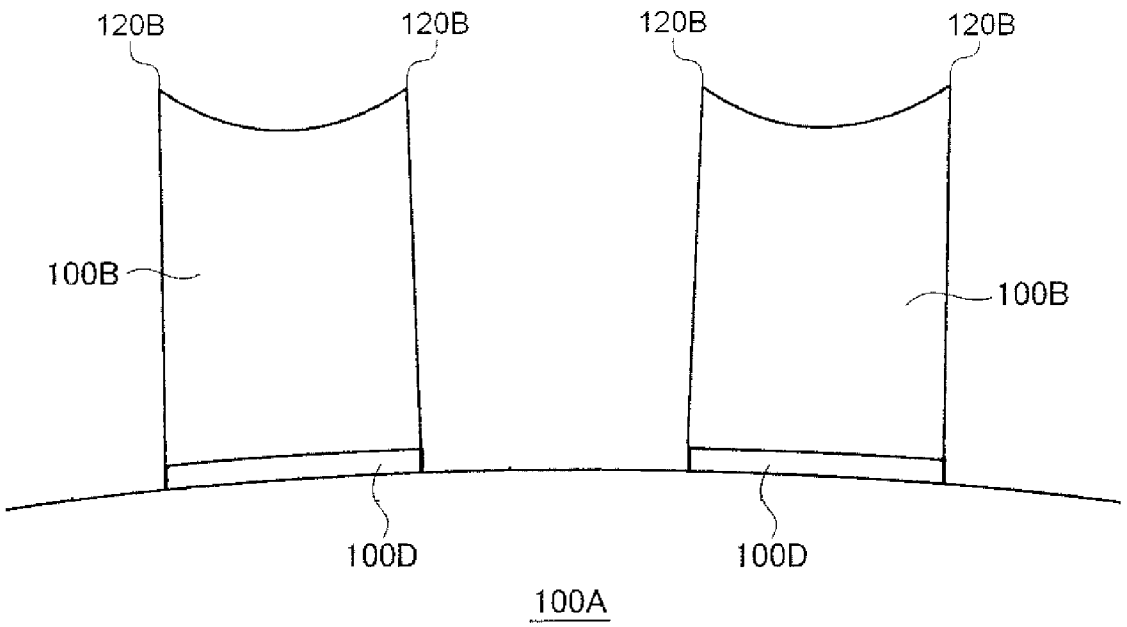
FIG. 10 is an enlarged sectional view illustrating the foamed elastic layer in the clean member in another exemplary embodiment.

Further, the foamed elastic layer 100B configured by spirally winding two or more strips 100C (strip-shaped foamed elastic members) around the core 100A may have a configuration in which the strips are disposed by being spirally wound around the core in a state where the sides in the longitudinal direction of the adhesive surface of the strip 100C (the surface on the side opposite to the outer circumferential surface of the core 100A in the strip 100C) are in contact with each other (refer to FIG. 9) or a configuration in which the strips are disposed by being spirally wound around the core in a state where the sides are not in contact with each other (refer to FIG. 10).

[Conductive Bearing and Power Supply]

Referring back to FIG. 1, a conductive bearing and a power supply in the charging device 12 illustrated in FIG. 1 will be described. The conductive bearing 123 is a member that integrally and rotatably holds the charging member 121 and the clean member 122 and holds axis distance between the members. By adjusting the axis distance, the biting amount between the charging member 121 and the clean member 122 is controlled. Specifically, the biting amount of the clean member 122 is adjusted by, for example, pressing both axial end portions of the shaft 122A toward the charging member 121 by a target load. Then, the foamed elastic layer 122B is pressed against the charging member 121, and the foamed elastic layer 122B is elastically deformed along the circumferential surface of the charging member 121 to form a contact region. The conductive bearing 123 may be of any material and form as long as it is made of a material having conductivity, for example, a conductive bearing or a conductive sliding bearing may be applied.

The foamed elastic layer 122B has a compression ratio calculated by [(thickness of original foamed elastic layer 122B−thickness of foamed elastic layer 122B in contact area of charging member 121)/thickness of original foamed elastic layer 122B]×100. Here, the thickness of the foamed elastic layer 122B refers to the thickness of the center portion in the width direction in a state where the foamed elastic layer 122B is disposed on the shaft 122A.

The biting amount of the clean member 122 with respect to the charging member 121 is obtained by a difference between an axial distance between the charging member 121 and the clean member 122 and a value obtained by adding an unloaded radius of the clean member 122 to an unloaded radius of the charging member 121. In a case where the biting amount is different in the axial direction of the clean member 122, the biting amount here means the minimum value.

The clean member 122 is driven to rotate by the rotation of the charging member 121. The present invention is not limited to the case where the clean member 122 is always in contact with the charging member 121, and a configuration in which the clean member 122 is in contact with the charging member 121 and is driven to rotate only when the charging member 121 is cleaned. In addition, the clean member 122 may be brought into contact the charging member 121 only when the charging member 121 is cleaned, and may be separately driven to rotate around the charging member 121 with a peripheral speed difference.

The power supply 124 is a device for charging the charging member 121 and the clean member 122 to the same polarity by applying a voltage to the conductive bearing 123, and a known high voltage power supply device is used.

<Image Forming Apparatus and Process Cartridge>

An image forming apparatus according to the exemplary embodiment includes a charging device that charges the surface of an image holding member (for example, a photoreceptor) according to a contact charging method. That is, the image forming apparatus according to the exemplary embodiment includes an image holding member, a charging device according to the exemplary embodiment that charges a surface of the image holding member, a developing device that forms an electrostatic latent image on the charged surface of the image holding member, a latent image forming device that forms a latent image on the charged surface of the image holding member, a developing device that develops the latent image formed on the surface of the image holding member with a developer containing toner to form a toner image on the surface of the image holding member, and a transfer device that transfers the toner image formed on the surface of the image holding member to a recording medium.

The image forming apparatus according to the exemplary embodiment may be further provided with at least one selected from a fixing device that fixes a toner image on a recording medium; a cleaning device that cleans the surface of the photoreceptor being charged after transferring the toner image; and erasing device that erases charges by irradiating the surface of the photoreceptor with erasing light before being charged after transferring the toner image.

As the image forming apparatus according to the exemplary embodiment, a direct-transfer type apparatus that directly transfers the toner image formed on the surface of the electrophotographic photoreceptor to the recording medium; and an intermediate transfer type apparatus that primarily transfers the toner image formed on the surface of the electrophotographic photoreceptor to a surface of an intermediate transfer body, and secondarily transfers the toner image transferred to the surface of the intermediate transfer body to the surface of the recording medium.

The process cartridge according to the exemplary embodiment is a cartridge (process cartridge) detachable from the image forming apparatus, and is provided with a charging device that charges the surface of the image holding member (for example, a photoreceptor) according to a contact charging method. That is, the process cartridge according to the exemplary embodiment is a process cartridge which is detachable from the image forming apparatus and is provided with an image holding member and the charging device according to the exemplary embodiment. The process cartridge according to the exemplary embodiment may be further provided with at least one selected from the developing device, the cleaning device of the photoreceptor, an erasing device of the photoreceptor, and the transfer device.

Hereinafter, the configurations of the charging device according to the exemplary embodiment, the image forming apparatus, and the process cartridge will be described with reference to the drawings.

Figure 11:
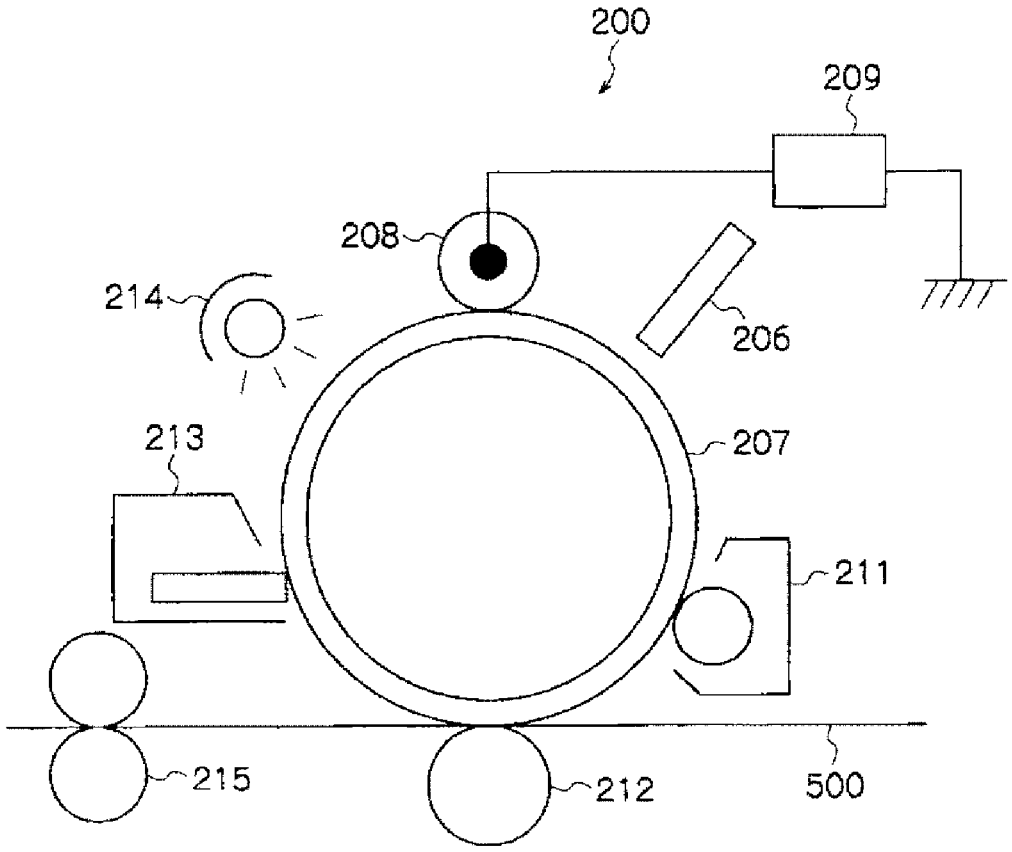
FIG. 11 is a schematic configuration diagram illustrating an example of an image forming apparatus according to an exemplary embodiment.
Figure 12:
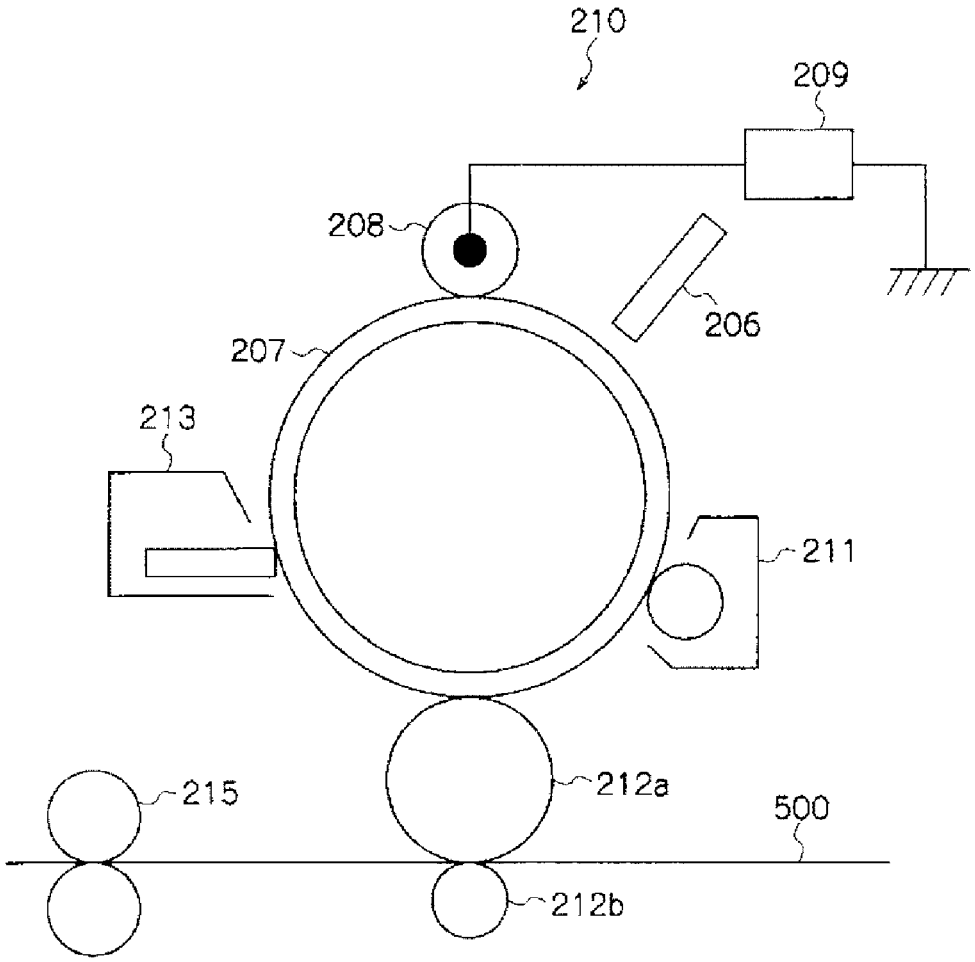
FIG. 12 is a schematic configuration diagram illustrating another example of the image forming apparatus according to the exemplary embodiment.

FIG. 11 is a schematic configuration diagram illustrating an example of the image forming apparatus according to the exemplary embodiment. FIG. 11 is a schematic view illustrating a direct transfer type image forming apparatus. FIG. 12 is a schematic configuration diagram illustrating another example of the image forming apparatus according to the exemplary embodiment. FIG. 12 is a schematic view illustrating an intermediate transfer type image forming apparatus.

The image forming apparatus 200 as illustrated in FIG. 11 is provided with an electrophotographic photoreceptor (also referred to simply as "photoreceptor") 207 as an example of an image holding member; a charging device 208 for charging the surface of the photoreceptor 207; a power supply 209 connected to the charging device 208; an exposure device 206 for exposing the surface of the photoreceptor 207 to form a latent image; a developing device 211 which develops the latent image on the photoreceptor 207 with a developer containing toner; a transfer device 212 for transferring the toner image on the photoreceptor 207 to a recording medium 500; a fixing device 215 for fixing the toner image on the recording medium 500; a cleaning device 213 for removing toner remaining on the photoreceptor 207; and a erasing device 214 for erasing the charge on the surface of the photoreceptor 207. The erasing device 214 may not be provided.

The image forming apparatus 210 as illustrated in FIG. 12 is provided with the photoreceptor 207, the charging device 208, the power supply 209, the exposure device 206, the developing device 211, a primary transfer member 212*a* and a secondary transfer member 212*b* for transferring the toner image on the photoreceptor 207 to the recording medium 500, the fixing device 215 and the cleaning device 213. Similar to the case of the image forming apparatus 200, the image forming apparatus 210 may not be provided with the erasing device.

The charging device 208 is a contact charging type charging device that includes a roll-shaped charging member and is in contact with the surface of the photoreceptor 207 to charge the surface of the photoreceptor 207. To the charging device 208, only DC voltage is applied, only AC voltage is applied, or a voltage in which AC voltage is superimposed on DC voltage is applied, from the power supply 209. As the charging device 208, a charging device according to the exemplary embodiment is applied. For example, the charging device 12 as illustrated in FIG. 1 may be applied to as the charging device 208.

Examples of the exposure device 206 include an optical device provided with a light source such as semiconductor laser, LED (light emitting diode).

The developing device 211 is a device that supplies toner to the photoreceptor 207. The developing device 211 brings a roll-shaped developer holding member into contact with or in proximity to the photoreceptor 207, for example, and causes toner to be attached to the latent image on the photoreceptor 207 to form a toner image.

Examples of the transfer device 212 include a corona discharge generator, conductive roll pressed against the photoreceptor 207 through the recording medium 500.

Examples of the primary transfer member 212*a* include a conductive roll that rotates while being in contact with the photoreceptor 207. Examples of the secondary transfer member 212*b* include a conductive roll that presses against the primary transfer member 212*a* through the recording medium 500.

Examples of the fixing device 215 include a heating fixing device including a heating roll and a pressure roll pressed against the heating roll.

Examples of the cleaning device 213 include a device provided with a blade, a brush, and a roll as clean members. Examples of the material of the cleaning blade include a urethane rubber, a neoprene rubber, and a silicone rubber.

The erasing device 214 is, for example, a device that erases the residual potential of the photoreceptor 207 by irradiating the surface of the photoreceptor 207 after transfer with light. The erasing device 214 may not be provided.

Figure 13:
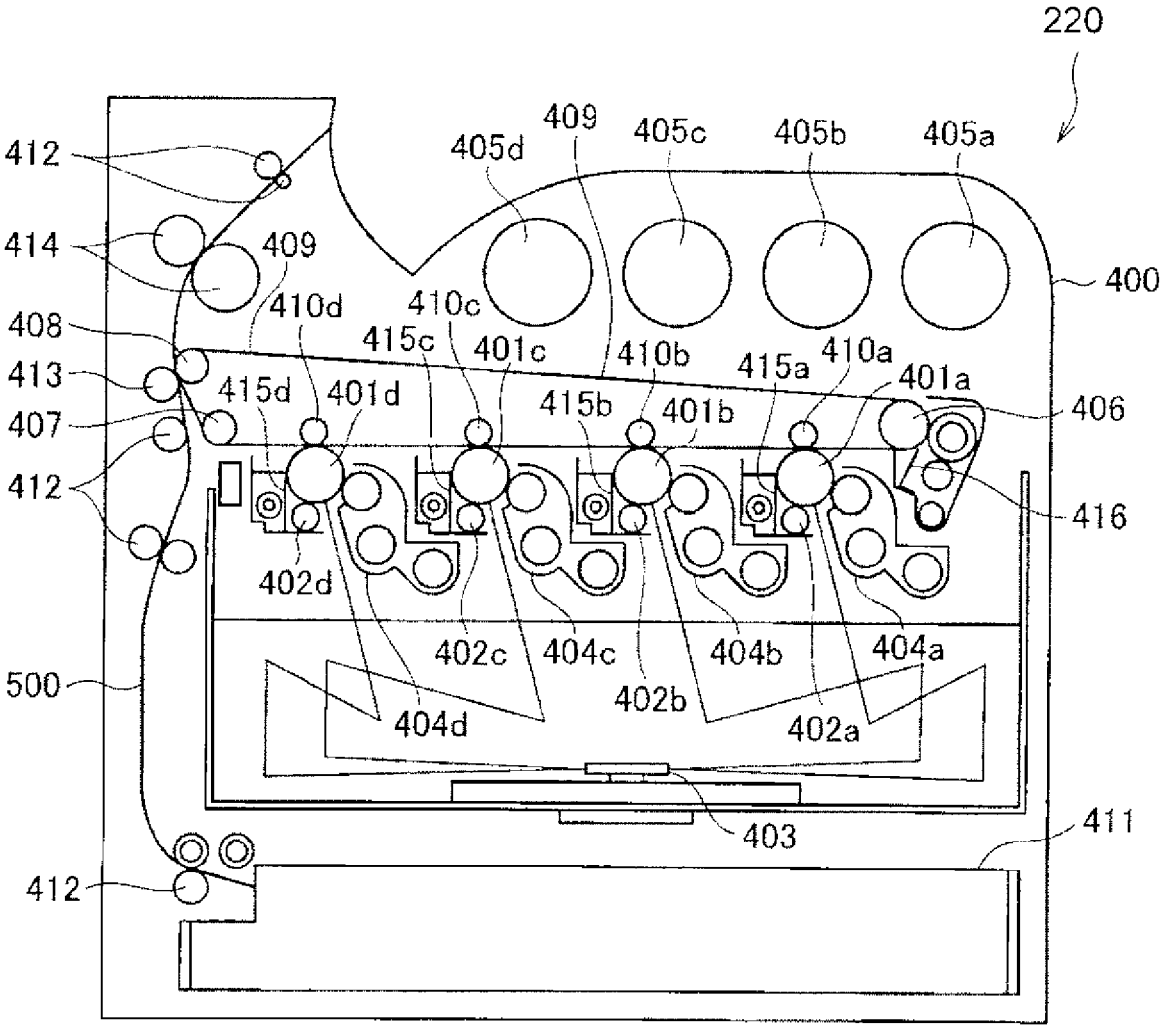
FIG. 13 is a schematic configuration diagram illustrating another example of the image forming apparatus according to the exemplary embodiment.

FIG. 13 is a configuration diagram illustrating an image forming apparatus which is another example of the image forming apparatus according to the exemplary embodiment. FIG. 13 is a schematic view illustrating a tandem type and intermediate transfer type image forming apparatus in which four image forming units are arranged in parallel.

The image forming apparatus 220 is provided with four image forming units corresponding to the respective colors in a housing 400, an exposure device 403 including a laser beam, an intermediate transfer belt 409, a secondary transfer roll 413, a fixing device 414, and a cleaning device including a cleaning blade 416.

Since the four image forming units have the same configuration, the configuration of the image forming unit including a photoreceptor 401*a* will be described as a representative. Corresponding elements of the other image forming units are also indicated. In the vicinity of the photoreceptor 401*a* (401*b*, 401*c*, 401*d*), a charging roll 402*a* (402*b*, 402*c*, 402*d*), a developing device 404*a* (404*b*, 404*c*, 404*d*), a primary transfer roll 410*a* (410*b*, 410*c*, 410*d*), and a cleaning blade 415*a* (415*b*, 415*c*, 415*d*) are arranged in order in the rotational direction of the photoreceptor 401*a* (401*b*, 401*c*, 401*d*). The primary transfer roll 410*a* is pressed against the photoreceptor 401*a* via the intermediate transfer belt 409. The toner stored in a toner cartridge 405*a* (405*b*, 405*c*, 405*d*) is supplied to the developing device 404*a*.

The charging roll 402*a* (402*b*, 402*c*, 402*d*) is a contact charging type charging member that is in contact with the surface of the photoreceptor 401*a* (401*b*, 401*c*, 401*d*) to charge the surface of the photoreceptor 401*a* (401*b*, 401*c*, 401*d*). To the charging roll 402*a* (402*b*, 402*c*, 402*d*), only DC voltage is applied, only AC voltage is applied, or a voltage in which AC voltage is superimposed on DC voltage is applied, from the power supply.

The intermediate transfer belt 409 is stretched by a drive roll 406, a tension roll 407, and a back roll 408, and travels by the rotation of these rolls.

The secondary transfer roll 413 is disposed to press the back roll 408 via the intermediate transfer belt 409.

The fixing device 414 is, for example, a heating fixing device provided with a heating roll and a pressure roll.

The cleaning blade 416 is a member for removing the toner remaining on the intermediate transfer belt 409. The cleaning blade 416 is disposed downstream of the back roll 408 and removes toner remaining on the intermediate transfer belt 409 after transfer.

A tray 411 for storing the recording medium 500 is provided in the housing 400. The recording medium 500 in the tray 411 is transported to the contact portion between the intermediate transfer belt 409 and the secondary transfer roll 413 by the transport roll 412, and further transported to the fixing device 414, and an image is formed on the recording medium 500. The recording medium 500 after image formation is output to the outside of the housing 400.

Figure 14:
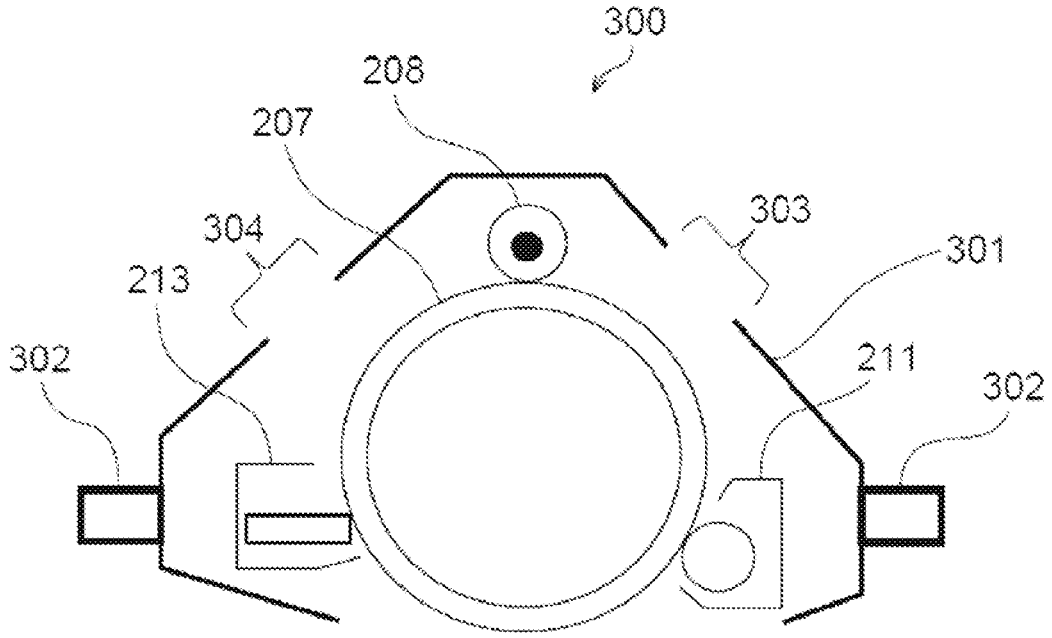
FIG. 14 is a schematic configuration diagram illustrating an example of a process cartridge according to the exemplary embodiment.

FIG. 14 is a schematic diagram illustrating an example of a process cartridge according to the exemplary embodiment. The process cartridge 300 as illustrated in FIG. 14 is, for example, detachably mounted to an image forming apparatus main body including an exposure device, a transfer device, and a fixing device.

In the process cartridge 300, the photoreceptor 207, the charging device 208, the developing device 211, and a cleaning device 213 are integrated by a housing 301. The housing 301 is provided with a mounting rail 302 to be detachable from the image forming apparatus, an opening 303 for exposure, and an opening 304 for charge erasing exposure.

The charging device 208 provided in the process cartridge 300 is a contact charging type charging device that includes a roll-shaped charging member and is in contact with the surface of the photoreceptor 207 to charge the surface of the photoreceptor 207. When the process cartridge 300 is mounted on the image forming apparatus and image formation is performed, to the charging device 208, only DC voltage is applied, only AC voltage is applied, or a voltage in which AC voltage is superimposed on DC voltage is applied, from the power supply.

<Developer and Toner>

The developer applied to the image forming apparatus according to the exemplary embodiment is not particularly limited. The developer may be a one-component developer containing only a toner, or a two-component developer in which a toner and a carrier are mixed.

The toner contained in the developer is not particularly limited. The toner contains, for example, a binder resin, a colorant, and a release agent. Examples of the binder resin of the toner include a polyester resin and a styrene-acrylic resin.

External additives may be externally added to the toner. Examples of the external additive for the toner include an inorganic fine particle such as silica, titania, and alumina.

The toner is produced by producing a toner particle and externally adding an external additive to the toner particle. Examples of the method of producing the toner particle include a kneading and pulverization method, an aggregation and coalescence method, a suspension polymerization method, and a dispersion polymerization method.

The toner particles may be toner particles having a single-layer structure, or toner particles having a so-called core and shell structure composed of a core (core particle) and a coating layer (shell layer) coated on the core.

The volume average particle diameter (D50v) of the toner particle is preferably 2 μm to 10 μm, and is more preferably 4 μm to 8 μm.

The carrier contained in the two-component developer is not particularly limited. Examples of the carrier include a coating carrier in which the surface of the core formed of magnetic particle is coated with a resin; a magnetic particle dispersion-type carrier in which the magnetic particle are dispersed and distributed in the matrix resin; and a resin impregnated-type carrier in which a resin is impregnated into the porous magnetic particles.

The mixing ratio (weight ratio) of the toner to the carrier in the two-component developer is preferably toner:carrier=1:100 to 30:100, and is more preferably 3:100 to 20:100.

EXAMPLES

Hereinafter, the exemplary embodiments of the invention will be described in detail with reference to examples, but the exemplary embodiments of the invention are not limited to these examples. In addition, "parts" is on a weight basis unless otherwise specified.

(Production of Charging Member)

[Production of Charging Roll 1]

—Preparation of Substrate—

A conductive substrate having a diameter of 8 mm and made of SUS303 is prepared.

—Formation of Adhesive Layer—

Subsequently, after mixing the following mixture with a ball mill for one hour, an adhesion layer having a film thickness of 10 μm is formed on the substrate surface by brushing.

- Chlorinated polypropylene resin (maleic anhydride chlorinated polypropylene resin, SUPERCHLON 930, produced by Nippon Paper Industries Co., Ltd.): 100 parts
- Epoxy resin (EP 4000, manufactured by ADEKA Corporation): 10 parts
- Conductive agent (carbon black, KETJEN BLACK EC, produced by Ketjenblack International Company): 2.5 parts In addition, toluene or xylene is used for viscosity adjustment.

—Formation of Elastic Layer—

- Epichlorohydrin rubber (HYDRINT3106, produced by ZEON CORPORATION): 100 parts by weight
- Carbon black (Asahi #60, produced by Asahi Carbon Co., Ltd.): 6 parts by weight
- Calcium carbonate (WHITON SB, Shiraishi Calcium Kaisha, Ltd.): 20 parts Part
- Ion conductive agent (BTEAC, manufactured by Lion Corporation): 5 parts by weight
- Vulcanization accelerator: stearic acid (produced by NOF Corporation): 1 part by weight
- Vulcanizing agent: sulfur (VULNOC R, produced by Ouchi Shinko Chemical Industrial Co., Ltd.): 1 part by weight,
- Vulcanization accelerator: zinc oxide: 1.5 parts by weight A mixture of the composition described above is kneaded with an open roll, and after forming a roll having a diameter of 12 mm using an extruder via an adhesive layer on the surface of a conductive substrate having a diameter of 8 mm formed of SUS303, the formed roll is heated at 180° C. for 70 minutes, and thereby an elastic layer (a conductive elastic layer) is obtained.

—Formation of Surface Layer—

- Binder resin: N-methoxymethylated nylon 1 (trade name F30K, produced by Nagase ChemteX Corporation): 100 parts by weight
- Particle A: carbon black (conductive agent, volume average particle diameter: 43 nm, trade name: MONAHRCH 1000, produced by Cabot Corporation): 15 parts by weight Particle B: polyamide particle (irregularities-forming particle, volume average particle diameter of 10 μm, polyamide 12, produced by Arkema S.A.): 5 parts by weight A mixture of the above composition is diluted with methanol and dispersed by a bead mill under the following conditions.

Bead material: Glass

Bead diameter: 1.3 mm

Propeller speed: 2,000 rpm

Dispersion time: 60 minutes

The dispersion obtained above is dip-coated on the surface of the conductive elastic layer and then dried by heating at a temperature of 145° C. for 30 minutes to form a surface layer having a thickness of 9 μm, and thereby a charging roll 1 is obtained.

[Production of Charging Roll 2]

A charging roll 2 is obtained in the same manner as in the production of the charging roll 1 except that the particle B (irregularities-forming particle) is a calcium carbonate particle (particle diameter of 20 μm, produced by New Lime, Co., Ltd.), the mixing amount is 10 parts by weight, and the film thickness of the surface layer is 5 μm.

[Production of Charging Roll 3]

A charging roll 3 is obtained in the same manner as in the production of the charging roll 1 except that the particle B (irregularities-forming particle) is a polyamide particle (particle diameter of 5 μm, Polyamide 12, produced by Arkema S.A.), the mixing amount is 22 parts by weight, and the film thickness of the surface layer is 9 μm.

[Production of Charging Roll 4]

A charging roll 4 is obtained in the same manner as in the production of the charging roll 1 except that the particle B (irregularities-forming particle) is a polyamide particle (particle diameter of 5 μm, Polyamide 12, produced by Arkema S.A.), the mixing amount is 35 parts by weight, and the film thickness of the surface layer is 11 μm.

[Production of Charging Roll 5]

A charging roll 5 is obtained in the same manner as in the production of the charging roll 1 except that the particle B (irregularities-forming particle) is a polyamide particle (particle diameter of 5 μm, Polyamide 12, produced by Arkema S.A.), the mixing amount is 9 parts by weight, and the film thickness of the surface layer is 11 μm.

(Production of Clean Member)

[Production of Cleaning Roll 1]

The urethane foam 1 (produced by Inoac Corporation) is cut into a size of 20 mm×20 mm×250 mm, a core material to be a core portion of 6 mm in diameter and 310 mm in length made of SUS303 is inserted, and then the core material and urethane foam are bonded to each other through a hot melt adhesive. Next, the urethane foam is cut off from both ends of the core material to 5 mm each so as to obtain an elastic roll material. The surface of the elastic roll is ground so as to obtain a cleaning roll 1 for a charging device, which has an outer diameter of 10 mm. The average cell diameter obtained from the number of cells is 0.3 mm.

[Production of Cleaning Roll 2]

A cleaning roll 2 is obtained in the same manner as in the production of the cleaning roll 1 except that in the production of the cleaning roll, urethane foam 2 (produced by Inoac Corporation) is used as the material of the elastic roll. The average cell diameter obtained from the number of cells is 0.4 mm.

[Production of Cleaning Roll 3]

A cleaning roll 3 is obtained in the same manner as in the production of the cleaning roll 1 except that in the production of the cleaning roll, urethane foam 3 (produced by Inoac Corporation) is used as the material of the elastic roll. The average cell diameter obtained from the number of cells is 0.18 mm.

[Production of Cleaning Roll 4]

A cleaning roll 4 is obtained in the same manner as in the production of the cleaning roll 1 except that in the production of the cleaning roll, urethane foam 4 (produced by Inoac Corporation) is used as the material of the elastic roll. The average cell diameter obtained from the number of cells is 1.0 mm.

[Production of Cleaning Roll 5]

The urethane foam 1 (produced by Inoac Corporation) is cut out to be a strip having a thickness of 2.4 mm, a width of 5 mm, and a length of 360 mm. A double-sided tape (No. 5605 produced by Nitto Denko Corporation) having a thickness of 0.05 mm is attached to the entire surface of the cut strip to obtain a strip with a double-sided tape.

The obtained strip with the double-sided tape is placed on a horizontal table with the release paper attached to the double-sided tape facing downward, and longitudinal ends are compressed from a top with heated stainless steel such that a thickness in a range of 1 mm in the longitudinal direction from each longitudinal end of the strip is 15% of a thickness of the other portion.

The obtained strip with the double-sided tape is placed on the horizontal table with the release paper attached to the double-sided tape facing upward, and is wound around a metallic core (material=SUM24EZ, outer diameter=ϕ 5.0 mm, entire length=360 mm) while applying a tension to the metallic core such that a spiral angle θ is 45° and the entire length of the strip is elongated in a range of 0% to 5%, thereby obtaining a cleaning roll 5.

[Production of Cleaning Roll 6]

A cleaning roll 6 is obtained in the same manner as in the production of the cleaning roll 5 except that urethane foam 1 (produced by Inoac Corporation) is changed to urethane foam 2 (produced by Inoac Corporation).

Example 1

[Production of Charging Device]

The charging roll 1 obtained above and the cleaning roll 1 obtained above are assembled such that the cleaning roll 1 is pressed against the outer circumferential surface of the charging roll 1 so as to obtain a charging device of Example 1.

Examples 2 to 7 and Comparative Examples 1 to 8

According to Table 3, the charging roll obtained above and the cleaning roll obtained above are combined to be assembled such that the cleaning roll is pressed against the outer circumferential surface of the charging roll so as to obtain a charging device of examples and comparative examples.

<Evaluation>

[Surface Properties of Surface Layer in Charging Member and Foamed Elastic Layer in Clean Member]

The ten-point average roughness Rz in the axial direction in the surface layer of the charging member, the distance Sm between irregularities, and the protruding peak height Spk are measured by the above-described method, and then calculation for Sm/Rz is performed. The width W of the nodal section of the foam cell wall surface of the foamed elastic layer of the clean member is measured by the above-described method. Then, calculation for Sm/W is performed.

[Image Quality Evaluation 1]

For the image quality evaluation, the charging device obtained in the above examples and the comparative examples is incorporated into a modified DOCUCENTTE-V C6675, 100,000 A4 sheets having a halftone image having an image density of 10% are output in an environment of low temperature and humidity (temperature of 10° C. and humidity of 15 RH %), and then one sheet having a halftone image having an image density of 10% is output. With respect to the finally-output one sheet having a halftone image having an image density of 10%, the image quality evaluation is performed with G0 to G5 according to a failure level of the image quality streak caused by the contamination generated on the charging roll. The image streak failures at levels G0 to G3 cause no problem in use.

[Image Quality Evaluation 2]

For the image quality evaluation, the charging device obtained in the above examples and the comparative examples is incorporated into a modified DOCUCENTTE-V C6675, 200,000 A4 sheets having a halftone image having an image density of 10% are output in an environment of low temperature and humidity (temperature of 10° C. and humidity of 15 RH %), and then one sheet having a halftone image having an image density of 10% is output. With respect to the finally-output one sheet having a halftone image having an image density of 10%, the image quality evaluation is performed with G0 to G5 according to a failure level of the image quality streak caused by the contamination generated on the charging roll. The image streak failures at levels G0 to G3 cause no problem in use.

TABLE 1

| | Charging roll | | | | | | |
|---|---|---|---|---|---|---|---|
| | Surface layer | | | | | | |
| | Irregularities-forming particle | | | | Axial direction | | |
| | Kinds | Particle diameter (μm) | Number Parts by weight | Film thickness (μm) | Rz (μm) | Sm (μm) | Sm/Rz |
| Charging roll 1 | Polyamide | 10 | 5 | 9 | 5 | 115 | 23 |
| Charging roll 2 | Calcium carbonate | 20 | 10 | 5 | 8 | 248 | 31 |
| Charging roll 3 | Polyamide | 5 | 22 | 9 | 7.5 | 135 | 18 |
| Charging roll 4 | Polyamide | 5 | 35 | 11 | 9 | 90 | 10 |
| Charging roll 5 | Polyamide | 5 | 9 | 11 | 4.5 | 225 | 50 |

TABLE 2

| | Cleaning roll | | | | | |
|---|---|---|---|---|---|---|
| | Material of foamed elastic layer | Shape of foamed elastic layer | Width W of nodal section of foam cell wall surface (μm) | Density (kg/m$^3$) | Number of foam cell (cells/ 25 mm) | Spiral angle (°) |
| Cleaning roll 1 | Urethane foam 1 | Cylindrical shape | 42 | 82 | 90 | — |
| Cleaning roll 2 | Urethane foam 2 | Cylindrical shape | 84 | 70 | 60 | — |
| Cleaning roll 3 | Urethane foam 3 | Cylindrical shape | 10 | 20 | 120 | — |
| Cleaning roll 4 | Urethane foam 4 | Cylindrical shape | 150 | 18 | 11 | — |
| Cleaning roll 5 | Urethane foam 1 | Spiral shape | 42 | 82 | 90 | 45 |
| Cleaning roll 6 | Urethane foam 2 | Spiral shape | 84 | 70 | 60 | 45 |

TABLE 3

| | Charging device | | Sm/ W | Sm/ Rz | W (μm) | Image quality evaluation 1 100,000 sheets | Image quality evaluation 2 200,000 sheets |
|---|---|---|---|---|---|---|---|
| | Charging roll | Cleaning roll | | | | | |
| Example 1 | Charging roll 1 | Cleaning roll 1 | 2.7 | 23 | 42 | G0 | G1 |
| Example 2 | Charging roll 1 | Cleaning roll 5 | 2.7 | 23 | 42 | G0 | G0 |
| Example 3 | Charging roll 2 | Cleaning roll 1 | 5.9 | 31 | 42 | G1 | G2 |
| Example 4 | Charging roll 2 | Cleaning roll 5 | 5.9 | 31 | 42 | G0 | G1 |
| Example 5 | Charging roll 3 | Cleaning roll 1 | 3.2 | 18 | 42 | G1 | G2 |
| Example 6 | Charging roll 3 | Cleaning roll 5 | 3.2 | 18 | 42 | G0 | G1 |

TABLE 3-continued

| | Charging device | | Sm/ | Sm/ | W | Image quality evaluation 1 100,000 | Image quality evaluation 2 200,000 |
|---|---|---|---|---|---|---|---|
| | Charging roll | Cleaning roll | W | Rz | (μm) | sheets | sheets |
| Example 7 | Charging roll 5 | Cleaning roll 5 | 5.4 | 50 | 42 | G2 | G3 |
| Comparative Example 1 | Charging roll 4 | Cleaning roll 1 | 2.1 | 10 | 42 | G3 | G4 |
| Comparative Example 2 | Charging roll 4 | Cleaning roll 5 | 2.1 | 10 | 42 | G3 | G4 |
| Comparative Example 3 | Charging roll 1 | Cleaning roll 2 | 1.4 | 23 | 84 | G4 | G5 |
| Comparative Example 4 | Charging roll 1 | Cleaning roll 6 | 1.4 | 23 | 84 | G3 | G4 |
| Comparative Example 5 | Charging roll 4 | Cleaning roll 2 | 1.1 | 10 | 84 | G5 | G5 |
| Comparative Example 6 | Charging roll 4 | Cleaning roll 6 | 1.1 | 10 | 84 | G4 | G5 |
| Comparative Example 7 | Charging roll 1 | Cleaning roll 3 | 11.5 | 23 | 10 | G5 | G5 |
| Comparative Example 8 | Charging roll 1 | Cleaning roll 4 | 0.8 | 23 | 150 | G5 | G5 |

From the above evaluation results, it is understood that the examples are excellent in the evaluation of the image streak evaluation as compared with the comparative examples. That is, it is understood that as compared with the comparative examples, the occurrence of image streak failure is prevented in the examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charging device comprising:

a charging member configured to charge an image holding member according to a contact charging method, and comprising a conductive substrate and a surface layer provided on the conductive substrate; and a clean member configured to clean the charging member while contacting the charging member, and comprising a shaft and a foamed elastic layer provided on the shaft, wherein a ratio of a distance between irregularities in an axial direction of the surface layer in the charging member (Sm) to a width of a nodal section of a foam cell wall surface protruding from a surface of the foamed elastic layer in the clean member (W) satisfies $2.4 \leq Sm/W \leq 5.9$.

2. The charging device according to claim 1, wherein, with respect to the charging member, a ratio of a ten-point average roughness of the surface layer in the axial direction (Rz) to the distance between irregularities (Sm) satisfies $15 \leq Sm/Rz \leq 35$, and with respect to the clean member, the width of the nodal section of the foam cell wall surface (W) is from 30 μm to 50 μm.

3. The charging device according to claim 1, wherein, with respect to the clean member, the foamed elastic layer is spirally disposed from one end portion side to the other end portion side of the shaft.

4. The charging device according to claim 3, wherein, with respect to the clean member, a number of cells of the foamed elastic layer is from 80 cells/25 mm to 105 cells/25 mm, and a spiral angle of the foamed elastic layer is from 5° to 70°.

5. The charging device according to claim 4, wherein, with respect to the clean member, the number of cells of the foamed elastic layer is from 85 cells/25 mm to 100 cells/25 mm, and the spiral angle of the foamed elastic layer is from 10° to 60°.

6. The charging device according to claim 1, wherein, with respect to the clean member, the width W of the nodal section of the foam cell wall surface is from 30 μm to 50 μm, and a density of the foamed elastic layer is from 60 $kg/m^3$ to 100 $kg/m^3$.

7. The charging device according to claim 1, wherein, with respect to the charging member, the surface layer contains an irregularities-forming particle.

8. The charging device according to claim 7, wherein, with respect to the charging member, the irregularities-forming particle is a polyamide particle.

9. The charging device according to claim 7, wherein, with respect to the charging member, the surface layer contains irregularities-forming particles having a volume average particle diameter of 5 μm to 20 μm in an amount of 5 parts by weight to 30 parts by weight with respect to 100 parts by weight of a binder resin contained in the surface layer.

10. A process cartridge comprising:

an image holding member; and the charging device according to claim 1, wherein the process cartridge is detachable from the image forming apparatus.

11. An image forming apparatus comprising:

the image holding member;

the charging device according to claim 1 which charges a surface of the image holding member;

a latent image forming device that forms a latent image on the charged surface of the image holding member;

a developing device that develops the latent image formed on the surface of the image holding member with a developer containing toner to form a toner image on the surface of the image holding member; and a transfer device that transfers the toner image formed on the surface of the image holding member to a recording medium.

* * * * *